US006530650B2

(12) United States Patent
Ozaki et al.

(10) Patent No.: US 6,530,650 B2
(45) Date of Patent: Mar. 11, 2003

(54) INK JET HEAD SUBSTRATE, INK JET HEAD, METHOD FOR MANUFACTURING INK JET HEAD SUBSTRATE, METHOD FOR MANUFACTURING INK JET HEAD, METHOD FOR USING INK JET HEAD AND INK JET RECORDING APPARATUS

(75) Inventors: Teruo Ozaki, Kanagawa (JP); Masami Ikeda, Tokyo (JP); Masami Kasamoto, Kanagawa (JP); Ichiro Saito, Kanagawa (JP); Hiroyuki Ishinaga, Tokyo (JP); Shuji Koyama, Kanagawa (JP); Yoshinori Misumi, Tokyo (JP); Junichiro Iri, Kanagawa (JP); Muga Mochizuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/915,422

(22) Filed: Jul. 27, 2001

(65) Prior Publication Data

US 2002/0024564 A1 Feb. 28, 2002

(30) Foreign Application Priority Data

Jul. 31, 2000 (JP) ..... 2000-232408
Sep. 4, 2000 (JP) ..... 2000-267820

(51) Int. Cl.[7] ..... B41J 2/05
(52) U.S. Cl. ..... 347/64
(58) Field of Search ..... 347/64

(56) References Cited

U.S. PATENT DOCUMENTS 4,312,240 A * 1/1982 Hermanns ..... 73/861.57
4,429,321 A 1/1984 Matsumoto
4,535,343 A * 8/1985 Wright et al. ..... 347/64
4,596,994 A * 6/1986 Matsuda et al. ..... 347/64
4,723,129 A 2/1988 Endo et al.
4,740,796 A 4/1988 Endo et al.
5,057,856 A 10/1991 Takagi et al.
5,170,244 A * 12/1992 Dohjo et al. ..... 257/72
5,187,602 A * 2/1993 Ikeda et al. ..... 349/39
5,434,363 A * 7/1995 Goto et al. ..... 174/256
5,660,739 A 8/1997 Ozaki et al. ..... 216/27
5,896,147 A 4/1999 Mori et al. ..... 347/61

FOREIGN PATENT DOCUMENTS

| | | |
|---|---|---|
| EP | 0318981 | 6/1989 |
| EP | 0976561 | 2/2000 |
| JP | 2683350 | 8/1997 |
| JP | 2000-62180 | 2/2000 |

OTHER PUBLICATIONS

Patent Abstracts of Japan; vol. 017, No. 414 (M–1456), Aug. 3, 1993 & JP 05 084910 A (Canon Inc), Apr. 6, 1993.
Patent Abstracts of Japan; vol. 017, No. 034 (M–1357), Jan. 22, 1993 & JP 255357 A (Ricoh Co Ltd), Sep. 10, 1992.
Patent Abstracts of Japan; vol. 1996, No. 03, Mar. 29, 1996 & JP 07 309009 A (Canon Inc), Nov. 28, 1995.

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

The present invention provides an ink jet head substrate comprising a heat generating resistance member forming a heat generating portion, an electrode wiring electrically connected to the heat generating resistance member, and an anti-cavitation film provided on the heat generating resistance member and the electrode wiring via an insulation protection layer, and wherein the anti-cavitation film is formed from different materials with more than two layers.

21 Claims, 12 Drawing Sheets

INK JET HEAD SUBSTRATE, INK JET HEAD, METHOD FOR MANUFACTURING INK JET HEAD SUBSTRATE, METHOD FOR MANUFACTURING INK JET HEAD, METHOD FOR USING INK JET HEAD AND INK JET RECORDING APPARATUS

BACKGROUND OF THE INVENTION

1. Field of the Invention

The present invention relates to an ink jet head for effecting recording by discharging ink, a substrate for such a head, methods for manufacturing the head and the substrate, a method for using such a head and an ink jet recording apparatus.

2. Related Background Art

An ink jet recording system disclosed in U.S. Pat. No. 4,723,129 or U.S. Pat. No. 4,740,796 can effect recording at a high speed with high accuracy and high image quality and is suitable for color recording and compactness. In a recording head using such an ink jet recording system and adapted to discharge ink onto a recording medium by bubbling the ink by means of thermal energy, heat generating resistance members for bubbling the ink and wirings for electrical connection thereto are formed on the same substrate to provide an ink jet recording head substrate, and nozzles for discharging the ink are generally formed on the substrate.

The ink jet recording head substrate has widely been devised in order to save electrical energy and to prevent reduction of a service life of the substrate due to mechanical damage caused by bubbling and destruction of a heat generating portion caused by thermal pulse. Particularly, many investigations have been made regarding a protection film for protecting a heat generating resistance member having a heat generating portion positioned between a pair of wiring patterns from ink.

In the viewpoint of heat efficiency, the protection film is advantageous to have high heat conductivity or smaller thickness. However, on the other hand, the protection film has the purpose for protecting the wirings connected to the heat generating member from the ink, and the film is advantageous to have greater thickness in consideration of probability of defect of the film, and an optimum thickness of the film is set in the viewpoint of energy efficiency and reliability. However, the protection film is subjected to both cavitation damage, i.e., mechanical damage due to the bubbling of ink and damage due to chemical reaction with high temperature ink component since a temperature of the surface of the film is increased after the bubbling.

Thus, in actual, it is difficult to make an insulation film for protecting the wirings and a film having stability with respect to mechanical and chemical damages compatible, and, for this reason, the protection film of the ink jet substrate is generally constituted by an upper layer having high stability with respect to mechanical and chemical damages due to the ink bubbling and a lower layer insulation layer for protecting the wirings. More specifically, a Ta film having very high mechanical and chemical stability is generally used as the upper layer, and an SiN film or an SiO film which can be formed easily and stably by an existing semiconductor device is generally used as the lower layer.

Explaining in more detail, an SiN film having a thickness of about 0.2 to 1 $\mu$m is formed as a protection film on the wirings, and then, an upper layer protection film, i.e., a Ta film having a thickness of 0.2 to 0.5 $\mu$m called as an anti-cavitation film having a function for resisting to cavitation is formed. With this arrangement, both the service life and reliability of the heat generating resistance member of the ink jet substrate can be enhanced.

Further, other than the mechanical and chemical damages, in the heat generating portion, coloring material and additives included in the ink are decomposed to a molecular level by high temperature heating to be changed into substance hard to solve, which is physically adhered to the anti-cavitation film as the upper layer protection film. This phenomenon is called as "kogation." As such, if organic or inorganic substance hard to solve is adhered to the anti-cavitation film, heat transfer from the heat generating resistance member to the ink becomes uneven, thereby making the bubbling unstable. In order to avoid this, although it is required that the kogation does not occur on the anti-cavitation film, the above-mentioned Ta film is generally adopted as a film having relatively good kogation resistance.

By the way, recently, as the performance of the ink jet printer has remarkably been enhanced, enhancement of performance of ink, for example, prevention of bleeding (smudge between different color inks) in correspondence to high speed recording has been requested, and enhancement coloring ability and weather resistance ability in correspondence to high image quality has been requested. To this end, various components are added to the ink, and, different components are added to three colors, i.e., yellow (Y), magenta (M) and cyan (C), which are kinds of inks for forming a color image.

As a result, for example, in an ink jet head in which heat generating portions for three colors (Y), (M), (C) and a Ta film, as the upper layer protection layer, are formed on the same substrate, from the difference between the ink components, in the heat generating portion corresponding to a certain color, the Ta film, which was regarded as stable film up to now, may also be eroded, with the result that the lower layer protection film and the heat generating member are also damaged to destroy the substrate. For example, when ink including bivalent metal salt such as Ca or Mg or component forming chelate body is used, the Ta film is apt to be eroded by thermal chemical reaction with ink.

On the other hand, other anti-cavitation films have been developed in correspondence to improvement of ink components. For example, in place of the Ta film, when amorphous alloy including Ta disclosed in Japanese Patent No. 2,683,350 according to the Applicant is used, even if the ink includes high erosive ink component, it was found that damage does almost not occur.

Thus, it can be considered that the amorphous alloy including Ta is used as the upper layer protection film for the heat generating portion in the ink jet head capable of discharging three color (Y, M, C) inks. However, although the amorphous alloy including Ta has high ink erosion resistance, since the surface of alloy is almost not subjected to damage, there is the tendency that kogation is apt to occur.

Thus, in the heat generating portion corresponding to a certain color, in place of the fact that the upper layer protection film is almost not eroded, a problem regarding kogation arises. In addition, when ink having high kogation ability in the different color ink is used, in the conventional Ta, although there was no problem regarding the kogation, when changed to the amorphous alloy including Ta, kogation will become noticeable. Incidentally, in the conventional Ta, the reason why the kogation does almost not occur is that slight erosion of Ta film and kogation occurs in a good balanced condition, with the result that accumulative generation of the kogation can be suppressed by the gradual erosion removal of the surface of the Ta film.

As mentioned above, in the arrangement in which either the Ta film or the amorphous alloy including Ta is used as the upper layer protection film contacted with the ink, it is difficult to make the service life and reliability of the ink jet head, separately, using ink having high kogation ability and high erosive ink on the same substrate well compatible.

SUMMARY OF THE INVENTION

In consideration of the above, an object of the present invention is to provide an ink jet head substrate capable of using both ink having high kogation ability and high erosive ink, an ink jet head utilizing such a substrate, and an ink jet recording apparatus having such a head.

Another object of the present invention is to provide an ink jet head substrate having a new intervention layer (or film) capable of removing factors for generating kogation and having no reduction of discharging speed in comparison with a conventional Ta protection film or a new anti-cavitation function capable of being contacted with liquid from an initial condition, an ink jet head utilizing such a substrate, a method for manufacturing such a substrate, and a method for using such a head.

A further object of the present invention is to provide a head capable of maintaining a property more positively in a head (for example, refer to Japanese Patent Application Laid-Open No. 2000-62180) including a movable member shifted by generation of a bubble and having an anti-cavitation layer providing a good discharging property. Particularly, although the head having the movable member has an advantage that higher frequency driving (than conventional one) can be effected, this property causes abrupt generation of the bubble with high frequency period and has a tendency that high level is requested to a bubble generating area. The present invention provides a new head substrate not only maintaining the advantage of such a head but also avoiding an influence affecting upon the anti-cavitation layer due to property (reactivity and/or high pH) of ink used.

To achieve the above object, the present invention provides an ink jet head substrate having a heat generating resistance member forming a heat generating portion, an electrode wiring electrically connected to the heat generating resistance member, and an anti-cavitation film provided on the heat generating resistance member and the electrode wiring via an insulation protection layer, and wherein the anti-cavitation film is formed from different materials more than two layers.

Further, the present invention provides an ink jet head substrate having a heat generating resistance member forming a heat generating portion, an electrode wiring electrically connected to the heat generating resistance member, and an anti-cavitation film provided on the heat generating resistance member and the electrode wiring via an insulation protection layer, and wherein the anti-cavitation film is formed from at least two layer films, and an upper layer film contacted with ink has lower ink erosion resistance than a lower layer film.

Further, the present invention provides an ink jet head substrate having a heat generating resistance member forming a heat generating portion, an electrode wiring electrically connected to the heat generating resistance member, and an anti-cavitation film provided on the heat generating resistance member and the electrode wiring via an insulation protection layer, and wherein the anti-cavitation film is formed from at least two layer films, and an upper layer film contacted with ink is a film on which kogation is relatively hard to occur, and a lower layer film is a film having high ink erosion resistance.

More specifically, in the anti-cavitation film, the upper layer film contacted with ink is a Ta film or a TaAl film, and the lower layer film is an amorphous alloy film including Ta.

The amorphous alloy film has a composition comprised of Ta, Fe, Ni and Cr is preferably represented as follows:

$$Ta_{\alpha}Fe_{\beta}Ni_{\gamma}Cr_{\delta} \quad (I)$$

(However, 10 at. $\% \leqq \alpha \leqq 30$ at. % and $\alpha+\beta<80$ at. % and $\alpha<\beta$ and $\delta>\gamma$ and $\alpha+\beta+\gamma+\delta=100$ at. %).

Particularly, it is preferable that the anti-cavitation film has a first layer represented by the formula (I):

$$Ta_{\alpha}Fe_{\beta}Ni_{\gamma}Cr_{\delta} \quad (I)$$

(However, 10 at. $\% \leqq \alpha \leqq 30$ at. % and $\alpha+\beta<80$ at. % and $a<\beta$ and $\delta>\gamma$ and $\alpha+\beta+\gamma+\delta=100$ at. %), and a second layer made of Ta and comprising a square grating crystal structure formed on the first layer.

Further, the present invention includes an ink jet head in which a liquid path communicated with a discharge port for discharging ink droplets is provided in correspondence to the heat generating portion on the above-mentioned ink jet head substrate. Particularly, in the ink jet head to which the head substrate of the present invention is applied, it is preferable that a plurality of flow paths communicated with the discharge ports are provided, and different inks are supplied to the respective flow paths. In this case, the different inks are at least ink apt to incur kogation and ink having high erosion ability.

Further, the present invention provides a method for manufacturing an ink jet head substrate having a heat generating resistance member forming a heat generating portion, an electrode wiring electrically connected to the heat generating resistance member, and an anti-cavitation film provided on the heat generating resistance member and the electrode wiring via an insulation protection layer, and wherein, in order to form the anti-cavitation film, a Ta film having a square grating crystal structure is formed on a layer having composition comprised of Ta, Fe, Ni and Cr by sputtering using a metal Ta target having purity of 99% or more. The layer having composition comprised of Ta, Fe, Ni and Cr is preferably represented as follows:

$$Ta_{\alpha}Fe_{\beta}Ni_{\gamma}Cr_{\delta} \quad (I)$$

(However, 10 at. $\% \leqq \alpha \leqq 30$ at. % and $\alpha+\beta<80$ at. % and $\alpha<\beta$ and $\delta>\gamma$ and $\alpha+\beta+\gamma+\delta=100$ at. %).

An ink jet head in which a liquid path communicated with a discharge portion for discharging ink droplets is provided in correspondence to the heat generating portion on the ink jet head substrate manufactured by such a manufacturing method is also included in the present invention.

In this case, in the ink jet head, it is preferable that the anti-cavitation film has initially two layers, and a stage in which the discharging is effected while partially removing an upper layer Ta and a stage in which the discharging is effected while removing the Ta only in an effective bubbling area can be performed.

Further, the present invention provides a method for manufacturing an ink jet head in which a liquid path communicated with a discharge port for discharging ink droplets is provided in correspondence to the heat generating portion on the ink jet head substrate having a heat generating resistance member forming a heat generating portion, an electrode wiring electrically connected to the heat generating resistance member, and an anti-cavitation film provided on the heat generating resistance member and the electrode wiring via an insulation protection layer, and wherein, in order to form the anti-cavitation film, a Ta film having a square grating crystal structure is formed on a layer having composition comprised of Ta, Fe, Ni and Cr by sputtering using a metal Ta target having purity of 99% or more. The layer having composition comprised of Ta, Fe, Ni and Cr is preferably represented as follows:

$$Ta_{\alpha}Fe_{\beta}Ni_{\gamma}Cr_{\delta} \quad (I)$$

(However, 10 at. $\% \leqq \alpha \leqq 30$ at. % and $\alpha+\beta<80$ at. % and $\alpha<\beta$ and $\delta>\gamma$ and $\alpha+\beta+\gamma+\delta=100$ at. %).

In this manufacturing method, after the flow path is formed, by performing a preliminary ink discharging operation, it is preferable that Ta is substantially doped to an amorphous immobile layer including at least Ta and Cr of the $Ta_{\alpha}Fe_{\beta}Ni_{\gamma}Cr_{\delta}$ layer.

Further, a method for using the ink jet head manufactured by this manufacturing method, wherein the layer obtained by substantially doping Ta into the amorphous immobile layer including at least Ta and Cr of the $Ta_{\alpha}Fe_{\beta}Ni_{\gamma}Cr_{\delta}$ layer is used as a first surface for the ink or as a layer exposed later, or wherein the layer obtained by adding Ta into the amorphous surface layer including at least Ta and Cr of the $Ta_{\alpha}Fe_{\beta}Ni_{\gamma}Cr_{\delta}$ layer is used as a first surface for the ink or as a layer exposed later is also included in the present invention.

Further, the present invention can preferably be applied to the above-mentioned ink jet head in which a movable member having a free end displaced by growth of a bubble generated in the liquid by thermal energy from the heat generating portion is positioned in each flow path.

Further, the present invention, also includes an ink jet recording apparatus having a carriage on which the above-mentioned ink jet head is mounted and effecting recording on a recording medium by discharging the ink droplet from the ink jet head while shifting the carriage in response to recording information.

BRIEF DESCRIPTION OF THE DRAWINGS

FIGS. 5A, 5B1 and 5B2 are views showing change in an anti-cavitation film of the present invention caused by ink having high Ta erosion ability in accordance with increase in the number of heater driving pulses;

DETAILED DESCRIPTION OF THE PREFERRED EMBODIMENTS

Figure 1A:
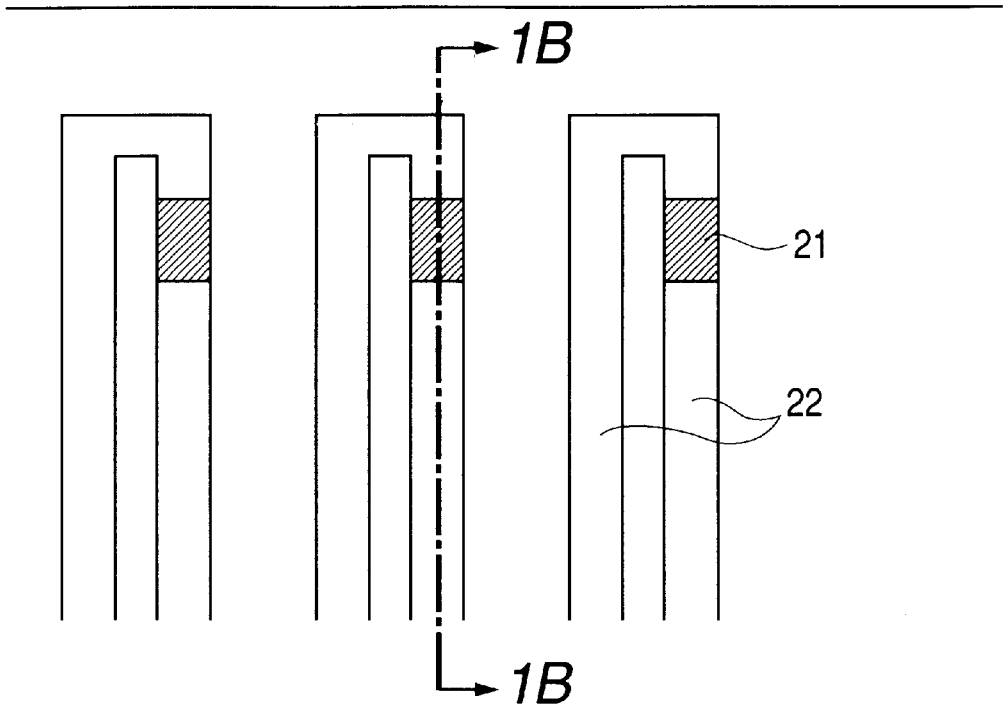
FIGS. 1A and 1B are views showing an ink jet head substrate according to a first embodiment of the present invention.

An ink jet head according to an embodiment of the present invention is designed so that ink paths communicated with discharge ports for discharging ink are provided on an ink jet head substrate having heat generating resistance members forming heat generating portions, wiring electrodes electrically connected to the heat generating resistance members, and an anti-cavitation film provided on the heat generating resistance members and the wirings via an insulation protection film. Particularly, the anti-cavitation film is constituted by two layers, wherein a lower layer is formed from amorphous alloy including Ta and an upper layer is formed from a Ta film having ink erosion resistance lower than that of the lower layer.

According to a construction of the head substrate as is in the present invention, for ink apt to incur kogation, since the upper Ta layer is removed slightly and gradually as the number of heater driving pulses is increased, accumulative generation of kogation is suppressed, thereby preventing reduction of bubbling efficiency. On the other hand, for ink having high erosion ability, although the upper Ta layer is removed as the number of heater driving pulses is increased, when the interface between the amorphous alloy layer including Ta and the upper Ta layer is reached, erosion is stopped. Accordingly, when the plural heat generating portions linearly aligned on the head substrate are used for respective kinds of inks, even if the kinds of inks include ink apt to incur kogation and ink apt to erode Ta, for both inks, the head substrate can provide both adequate service life and adequate reliability.

Further, in the present invention, in a liquid discharge head having a movable member in which a high frequency driving area can be selected to 10 kHz level and a level from about 20 kHz to 30 kHz is permitted, as an anti-cavitation film, a two-layer structure anti-cavitation film in which a film including Ta and having square grating crystal structure is formed on a film including Ta and having an amorphous structure can be applied. In the liquid discharge head having the movable member, disappearance of the bubble is repeated with the above-mentioned high frequency period, and many accumulation stresses is given to the anti-cavitation film within a unit time. However, according to the anti-cavitation film of the present invention, the discharging speed and the discharge amount are stabilized, with the result that the advantage of the movable member can be maintained effectively for a long term. In addition, an influence affecting upon the anti-cavitation layer due to property (reactivity and/or high pH) of ink used can be avoided.

Now, partial characteristics of the anti-cavitation film of the present invention will be described in more detail.

An amorphous alloy protection layer of $Ta_\alpha Fe_\beta Ni_\gamma Cr_\delta$ (however, 10 at. %≦α≦30 at. % and α+β<80 at. % and α<β and δ>γ and α+β+γ+δ=100 at. %) as the first anti-cavitation film is provided at its surface with a passivation film. It is guessed that, by starting sputtering of metal Ta having purity of 99% or more in order to form the second anti-cavitation film on this portion, any change for enhancing endurance is given to an interface between square grating crystal structure Ta layer as the second anti-cavitation film formed and the amorphous alloy protection layer or to a surface area (namely, passivation film such as Cr, Ta) of the amorphous alloy protection layer.

As a first factor, by substantially doping Ta used in the second anti-cavitation film to the passivation film area (including Cr, Ta) of the first anti-cavitation film by magnetron sputtering, the amorphous immobile film including Ta, Cr such as Ta (Fe, Ni, Cr) as amorphous body (non-crystal body) is reformed, thereby eliminating the cause of generation of kogation and enhancing endurance.

Accordingly, according to this first factor, the present invention may be an ink jet head substrate or an ink jet head having such a substrate, in which the layer obtained by doping Ta into the amorphous immobile layer including at least Ta and Cr is used as a first surface for the ink or as a layer exposed layer. Among them, in the former case, the discharging speed can be made to a stable speed from an initial condition, and, in the latter case, the endurance period while the first surface is removed by the cavitation can be added.

As a second factor, a part of Ta (namely, β-Ta) of the later-formed square grating crystal structure is firmly remained on the surface of the amorphous structure of the first anti-cavitation film to reform the surface, thereby enhancing endurance and kogation adhering suppressing effect.

This may be added to the first factor. In any cases, similar to the first factor, the second factor gives the effect solely and provides "structure in which Ta is added to the surface" in place of "layer to which Ta is doped".

As a third factor, Ta relating to both or either of first and second factors is doped to the amorphous body of the first anti-cavitation film or passivation film thereof, as a result that the removed (eroded) β-Ta layer is subjected to pressure due to cavitation. Namely, when the Ta is substantially doped (also called as reverse-sputtering) by aging in the manufacture of the head (preliminary liquid discharging is previously effected as a manufacture ending process) or bubble disappearing action during usage, Ta acts on Ta to be removed (eroded) or on Ta firmly adhered to the surface of the amorphous body or on Ta doped in the passivation film, thereby forming the anti-cavitation film itself or surface thereof having more excellent endurance and prevention of occurrence of kogation.

The third factor can also be regarded as the sole characteristic of the present invention.

Of course, it can be understood that, when the first factor is obtained as the first surface for contacting with the ink, β-Ta crystal structure film is removed by using the aging in the manufacture of the head. Further, a combination of the first to third factors and a combination of first and third factors constitute the sole characteristic of the present invention, respectively.

In this example, while the upper layer anti-cavitation film was formed from Ta, any material may be used, so long as such material is gradually eroded by the ink. Further, while the lower layer anti-cavitation film was formed from amorphous alloy including Ta, any material may be used, so long as such material has high ink erosion resistance.

Further, when it is considered that service lives of the heat generating portions relating to different color ink characteristics (i.e., ink apt to generate kogation and ink having high erosion resistance) are extended by using different materials, the kinds of the anti-cavitation films are not limited to two, but, three or more films may be used, or performance of the protection film may be further improved to provide ink erosion resistance.

Now, embodiments of the present invention will be explained with reference to the accompanying drawings.

(First Embodiment)

Figure 1B:
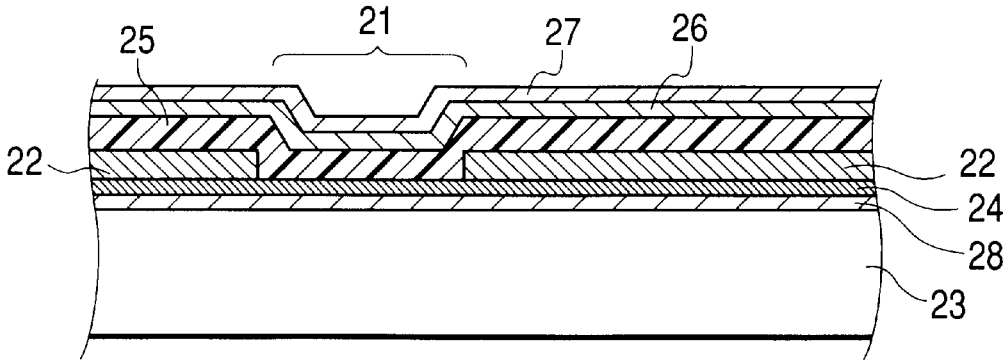

FIGS. 1A and 1B show an ink jet head substrate according to a first embodiment of the present invention, where FIG. 1A is a schematic top view showing main parts of the head substrate, and FIG. 1B is a schematic side sectional view taken along the line 1B—1B in FIG. 1A.

As shown in FIGS. 1A and 1B, a silicon oxide film as a heat accumulation layer 28 is formed on an Si substrate 23, and a heat generating resistance layer 24 and aluminum layers as electrode wirings 22 are formed on the layer 28 with predetermined patterns. A portion of the heat generating resistance layer 24 disposed between a pair of electrode wirings 22 constitutes a heat generating portion 21 for abruptly heating and boiling ink.

A silicon nitride layer as a protection film 25 for mainly maintaining insulation between the electrodes 22 is formed to cover the heat generating resistance layer 24 and the electrode wirings 22, and an amorphous alloy film including Ta and having high ink erosion resistance as a lower layer anti-cavitation film 26 and a Ta film having relatively good kogation ability as an upper layer anti-cavitation film 27 are successively formed thereon. Further, the upper layer anti-cavitation film 27 has ink erosion resistance lower than that of the lower layer anti-cavitation film 26.

The amorphous alloy film including Ta as the first anti-cavitation film 27 comprises Ta, Fe, Ni and Cr. By using such alloy, the ink erosion resistance is increased. Further, one or more atoms selected from a group including Ti, Zr, Hf, Nb and W may be included.

Further, as the amorphous alloy, amorphous alloy including Ta and represented by the following composition (I) is preferable:

$$Ta_\alpha Fe_\beta Ni_\gamma Cr_\delta \quad (I)$$

(However, 10 at. %≦α≦30 at. % and α+β<80 at. % and α<β and δ>γ and α+β+γ+δ=100 at. %).

In this case, an amount of Ta is set to a range from 10 at. % to 30 at. %, which is lower than that of the amorphous alloy including Ta and having the above composition. By adopting such a low Ta ratio, a moderate amorphous area is added to the alloy to provide a passivation film, with the result that existing points of crystal interface creating base of erosion reaction are reduced effectively, thereby enhancing ink resistance while maintaining anti-cavitation ability to a good level.

Particularly, for ink including bivalent metal salt such as Ca or Mg or component forming chelate body, the effect as the passivation film is achieved, thereby preventing ink erosion. Incidentally, in the above composition (I), it is more preferable that α is 10 at. %≦α≦20 at. %. Further, more preferably, γ≧7 at. % and δ≧15 at. %, and γ≧8 at. % and δ≧17 at. %.

On the other hand, Ta as the second anti-cavitation film 26 is Ta (also called as β-Ta) comprised of square grating crystal structure and has a property in which Ta is gradually removed little by little by cavitation generated in the disappearance of the bubble in the heat generating portion 21, and more specifically, it is a Ta film (layer) having square grating crystal structure formed by sputtering using a metal Ta target having purity of 99% or more, as will be described later.

Next, a method for manufacturing the ink jet head substrate having the above-mentioned structure will be explained with reference to FIGS. 2A to 2D and FIGS. 3A to 3D.

Figure 2A:
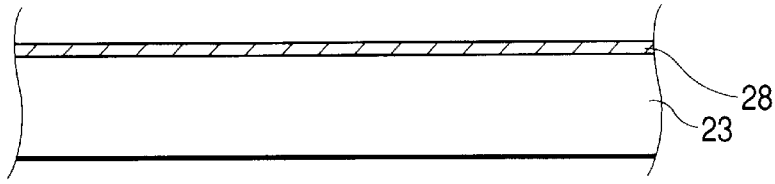
FIGS. 2A, 2B, 2C and 2D are views showing forward stage steps of a method for manufacturing the ink jet head substrate shown in FIGS. 1A and 1B.

As shown in FIG. 2A, a silicon oxide film having a thickness of 2400 nm forming a heat accumulation layer 28 as an underground for the heat generating member is formed on an Si substrate 23 by a thermal oxidation method, a sputtering method or a CVD method.

Figure 2B:
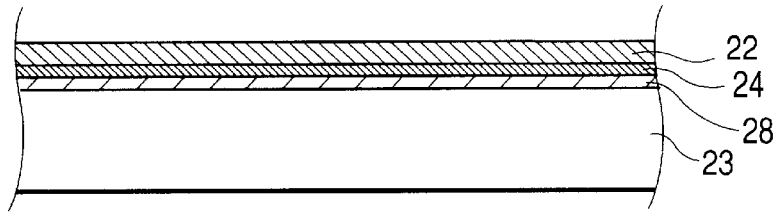

Then, as shown in FIG. 2B, a TaN layer having a thickness of about 100 nm as a heat generating resistance layer 24 is formed on the heat accumulation layer 28 by reactive sputtering, and an aluminum layer having a thickness of 500 nm as electrode wirings 22 is formed by sputtering.

Figure 2C:
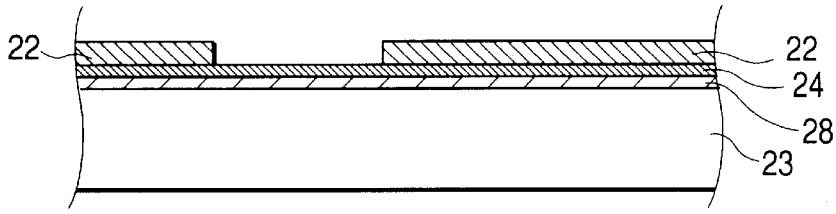

Then, the aluminum layer is wet-etched by using a photolithography method, and further, the TaN layer is subjected to reactive etching, thereby forming the electrode wirings 22 and the heat generating resistance layer 24 having cross-sectional areas shown in FIG. 2C (regarding plan view, refer to FIG. 2A). The heat generating portion 21 shown in FIGS. 1A and 1B is a portion of the heat generating resistance layer 24 from which the aluminum layer is removed and serves to apply heat to ink when electrical current is supplied between the electrode wirings 22.

Figure 2D:
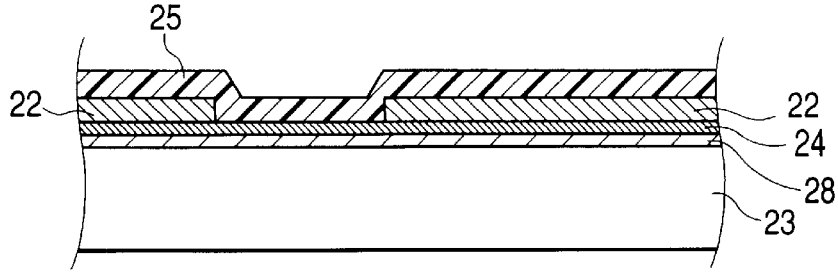
Figure 3A:
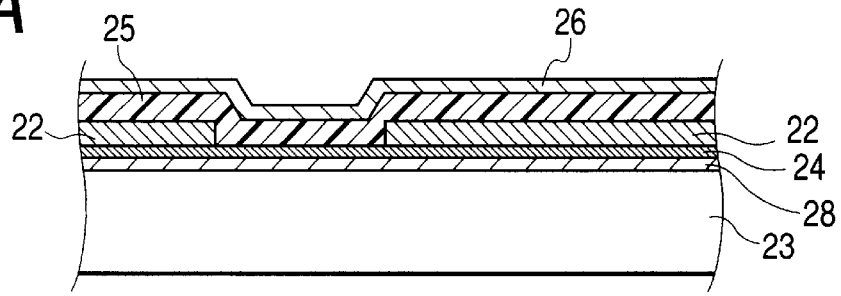
FIGS. 3A, 3B, 3C and 3D are views showing subsequent steps following to the steps shown in FIGS. 2A, 2B, 2C and 2D.

Then, as shown in FIG. 2D, a silicon nitride film having a thickness of 1000 nm as a protection layer 25 is formed by sputtering, and, further, as shown in FIG. 3A, an amorphous alloy film including Ta and having a thickness of about 100 nm and having composition of Ta: about 8 at. %, Fe: about 60 at. %, Cr: 13 at. % and Ni: about 9 at. % is formed by sputtering as a lower layer anti-cavitation film 26. The amorphous alloy film including Ta can be formed by a two-dimensional sputtering method in which powers are applied from two power supplies connected to a Ta target and an Fe—Cr—Ni target, as well as a sputtering method using an alloy target comprised of Ta—Fe—Cr—Ni.

Figure 3B:
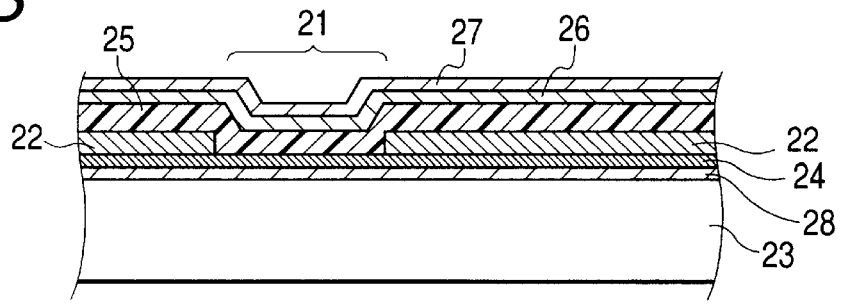

Further, as shown in FIG. 3B, a Ta (also called as β-Ta) layer having a thickness of about 150 nm and including square grating crystal structure is formed as an upper layer anti-cavitation film 27 by magnetron sputtering by using a metal Ta target having purity of 99% or more (preferably, 99.99%). Incidentally, so long as β-Ta having the above crystal structure is formed, a sputtering method other than the magnetron sputtering may be used.

In this case, Ta is doped to a surface portion of α-Ta (Cr, Fe, Ni) layer as the lower layer amorphous alloy film including Ta. However, although the amorphous structure of α-Ta layer is not greatly altered, by doping Ta to the surface area, it is considered that Ta becomes rich at the surface portion. In this case, since α-Ta (Cr, Fe, Ni) layer has relatively much Cr, it is considered that doping with Ta rich is effected to the passivation layer such as Cr. It is guessed that this portion at least enhances the endurance of the protection layer.

Figure 3C:
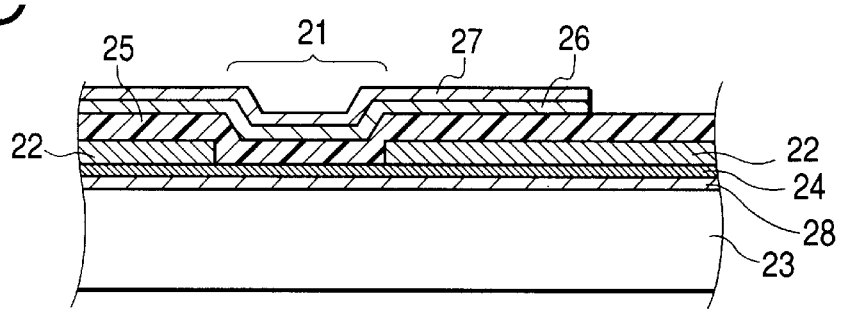

Then, as shown in FIG. 3C, a resist pattern is formed on Ta by using a photolithography method, and Ta of the upper layer and the amorphous alloy film including lower layer Ta is successively subjected to etching by using etching liquid mainly including hydrofluoric acid and nitric acid, thereby obtaining predetermined shapes.

Figure 3D:
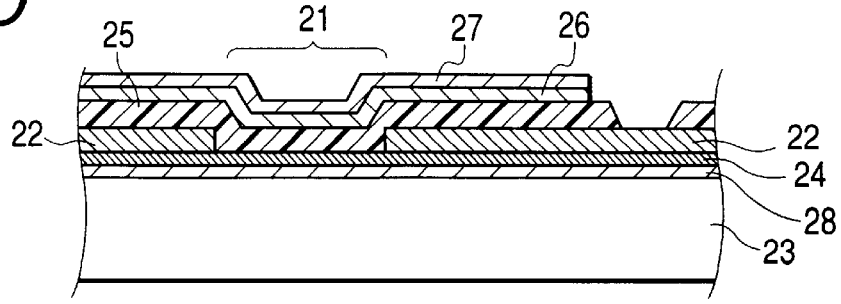

Then, as shown in FIG. 3D, a resist pattern is formed on the protection film by a photolithography method, and electrode pads as aluminum electrodes required for connection to an external power supply are exposed by dry etching using $CF_4$ gas. In this way, the manufacture of main parts of the ink jet recording head substrate is completed.

Incidentally, as disclosed in U.S. Pat. No. 4,429,321, an integrated circuit for driving the heat generating members may be incorporated into the same Si substrate. In this case, similar to the wirings, it is preferable that the integrated circuit is covered by the protection film 25, first anti-cavitation film 26 and second anti-cavitation film 27.

The ink jet head (for example, refer to head shown in FIG. 4) was assembled by using the ink jet head substrate manufactured in this way, and the nozzle array formed on the same substrate was divided into three, and cyan ink having high erosion ability, and yellow and magenta inks relatively apt to incur accumulation of kogation were supplied to the divided three nozzle arrays, respectively, and performance of this head was checked. As a result, it was found that the heater is not damaged in the heater portion using cyan ink, and kogation does almost not occur and discharging power is not reduced in the heater portions using yellow and magenta inks, with the result that a service life of the head up to about 1×10E9 pulses can be ensured.

Figure 5A:
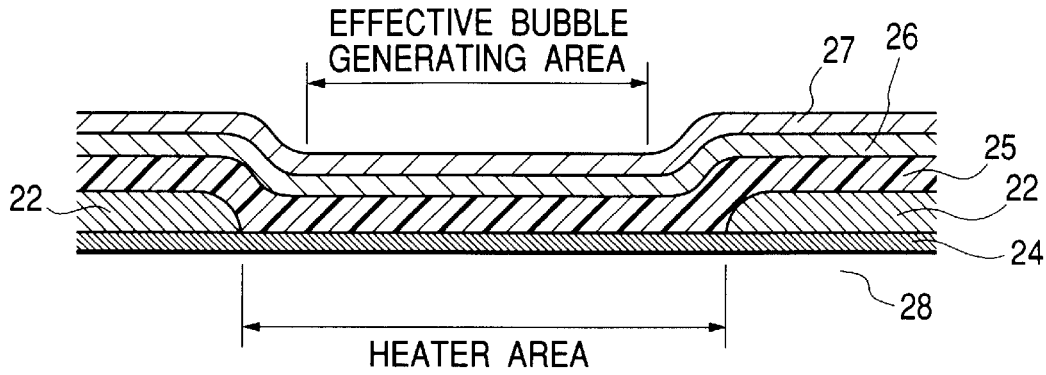
Figure 5A:
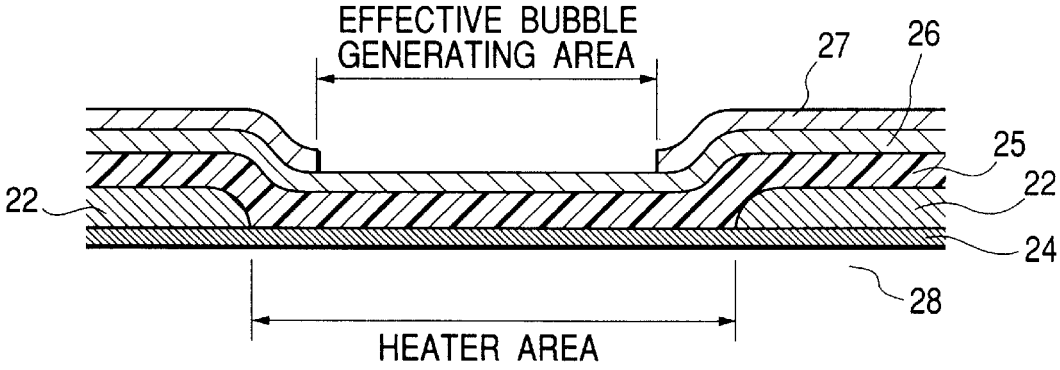
Figure 5A:
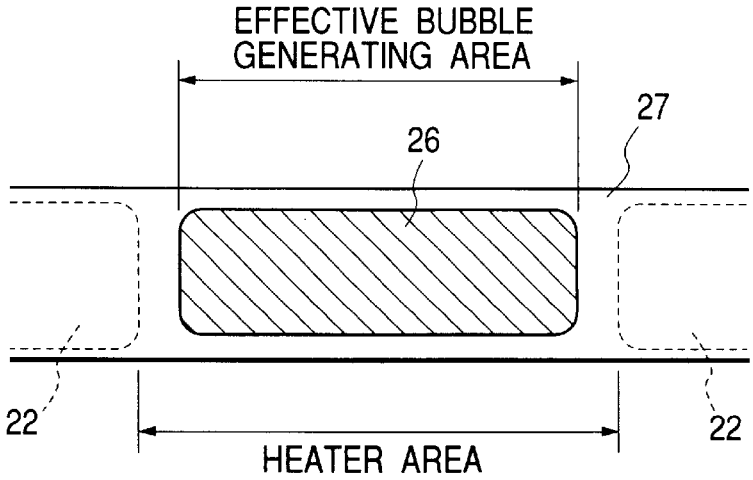

Here, FIGS. 5A, 5B1 and 5B2 show change in the anti-cavitation film of the present invention due to ink having high Ta erosion ability, in accordance with the increase in the number of heater driving pulses. FIGS. 5A, 5B1 and 5B2 are enlarged views showing the heat generating portion shown in FIG. 1B and there around, where FIG. 5A is a sectional view showing films when the number of heater driving pulses $\leqq 2\times10^8$, FIG. 5B1 is a sectional view showing films when the number of heater driving pulses $>2\times10^8$, and FIG. 5B2 is a plan view of FIG. 5B1.

In an initial condition shown in FIG. 5A, since the upper layer comprises Ta film 27, even when the ink apt to relatively incur accumulative kogation is used, kogation does almost not occur in the heater portion and the discharging power is not reduced. The reason is assumed that, as the number of driving pulses is increased, the surface of Ta film is removed little by little, thereby suppressing accumulative occurrence of kogation. This effect can be obtained by using TaAl, as well as Ta film used as the upper layer anti-cavitation film 27 as is in this example.

On the other hand, when the number of heater driving pulses is increased from the initial condition, Ta film 27 contacted with the ink having high Ta erosion ability is gradually eroded, and ultimately, as shown in FIGS. 5B1 and 5B2, the amorphous alloy film 26 including Ta is exposed in an effective bubbling area (area where heat generated at an area (heater area) where the heat generating resistance member exists between the electrode wirings effectively acts for bubbling the ink), with the result that the erosion due to ink is stopped at the interface between the amorphous alloy film 26 including Ta and the Ta film 27. This effect can similarly be obtained by using substance having ink erosion resistance, for example, anti-cavitation film 26 having a surface on which an oxide film including Cr oxide is formed, as well as the amorphous alloy film including Ta used as the lower layer anti-cavitation film 26 as is in this example.

Further, in the process from FIGS. 5A and 5B1 when β-Ta layer being removed is subjected to pressure created by cavitation during the ink bubbling, Ta is doped to the amorphous body of the amorphous alloy surface layer including Ta or passivation film thereof. Namely, when the Ta is substantially doped (also called as reverse-sputtering)

to the amorphous body of the amorphous alloy surface layer including Ta or passivation film thereof by aging in the manufacture of the head (preliminary liquid discharging is previously effected as a manufacture ending process) or bubble disappearance action during usage, the anti-cavitation surface layer or the entire film having excellent endurance and preventing occurrence of kogation can be formed. Incidentally, from the above reason, when the ink jet head substrate and the head having such a substrate are used by mounting them to the recording apparatus, the layer obtained by doping β-Ta to the amorphous body of the amorphous alloy surface layer including Ta or passivation film thereof may be used s a first surface for the ink or be exposed later. In this case, in the former head, the discharging speed can be stabilized from the initial condition, and, in the latter head, a time period hard to incur kogation until the first surface is removed by cavitation can be added.

Figure 6:
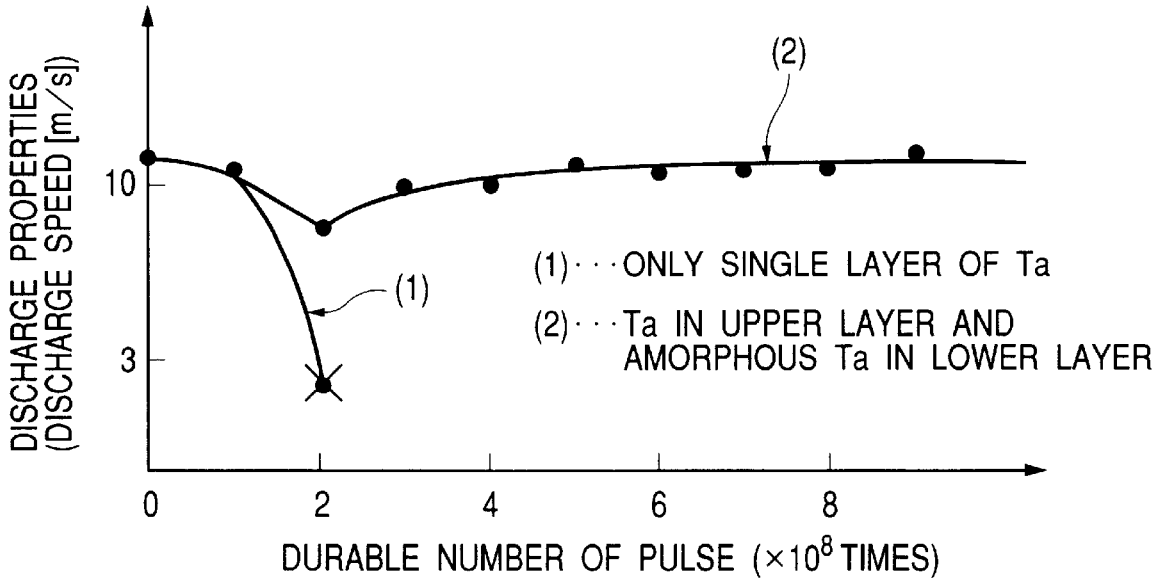
FIG. 6 is a graph for comparing a service life between an anti-cavitation film constituted an upper layer made of Ta and a lower layer made of amorphous alloy including Ta according to the present invention and an anti-cavitation film including a single Ta layer, when ink having high Ta erosion ability is used.

From the above, as shown in FIG. 6, the service life of the heater portion using the ink having high Ta erosion ability is considerably extended in comparison with the anti-cavitation film comprising a single Ta layer, and, at the same time, regarding the heater portion using the ink apt to incur accumulative kogation, good bubbling efficiency can be maintained.

(Second Embodiment)

Next, an example of an ink jet head to which the above-mentioned ink jet head substrate can be applied will be explained.

Figure 4:
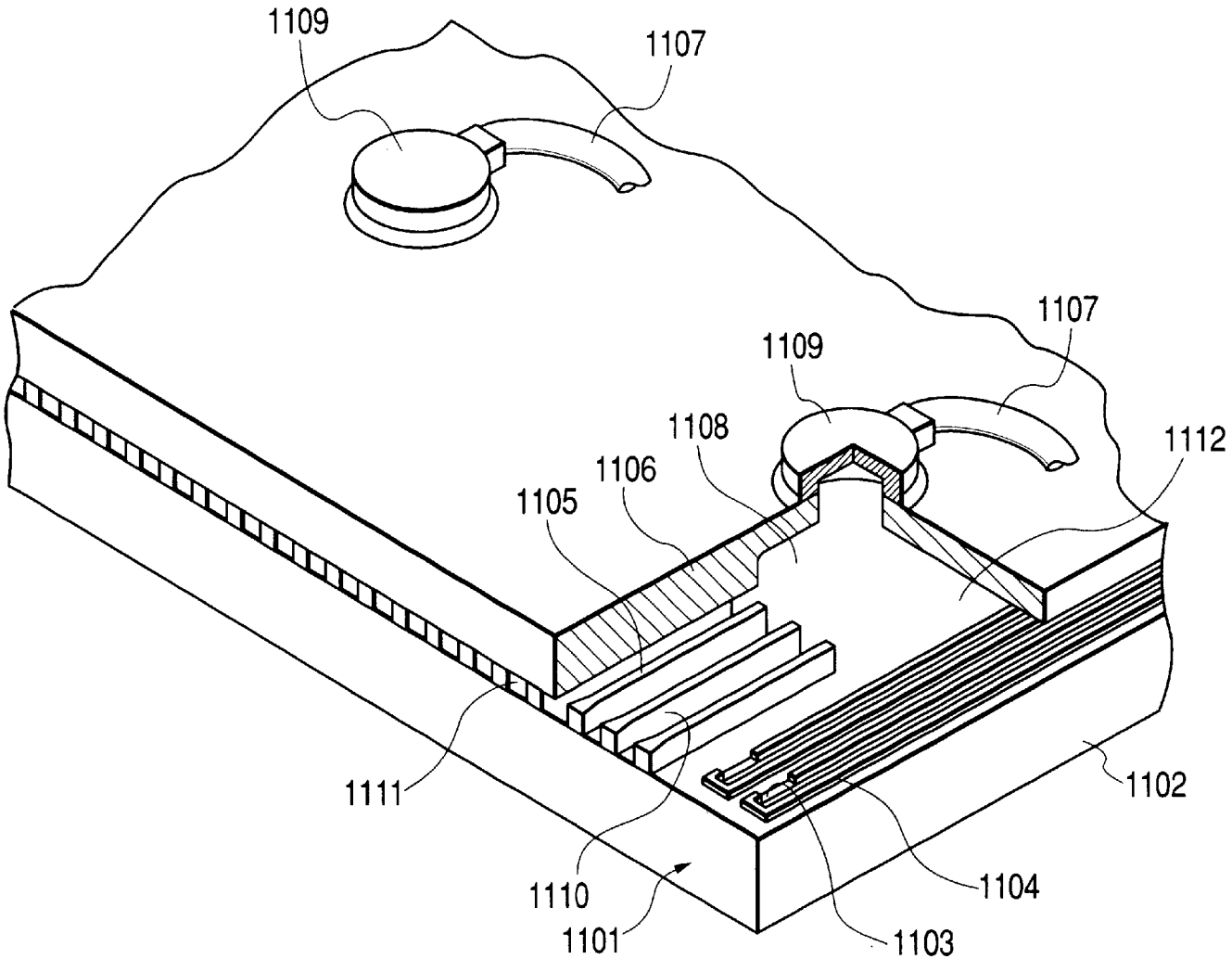
FIG. 4 is a perspective view, partial in section, of an ink head assembled by using the head substrate shown in FIGS. 1A and 1B.

FIG. 4 is a perspective view, in partial section, showing main parts of an ink jet head assembled by using the head substrate shown in FIGS. 1A and 1B. According to FIG. 4, an ink jet head 1101 constituted by heat generating resistance members 1103, wiring electrodes 1104, liquid flow path walls 1110 and a top plate 1106 which are formed on a head substrate 1102 as shown in FIGS. 1A and 1B through semiconductor processes such as etching and deposition sputtering is shown.

Recording liquid 1112 is supplied from a liquid storing chamber (not shown) to a common liquid chamber 1108 of the head 1101 through a liquid supply tube 1107. In FIG. 4, the reference numeral 1109 denotes a connector for the liquid supply tube. The liquid 1112 supplied to the common liquid chamber 1108 is supplied to the liquid flow paths by a so-called capillary phenomenon and is stably held by forming meniscus at discharge port surface (orifice surface) communicated with distal ends of the flow paths. Further, electrical/thermal converters 1103 are provided in the respective liquid flow paths. The liquid flow paths are defined by joining the top plate 1106 to the liquid flow paths walls 1110. Further, the liquid supply tube connectors 1109, common liquid chambers 1108 and plural liquid flow paths communicated thereto are partitioned on the same head substrate for types (for example, colors) of recording liquids.

By energizing the electrical/thermal converter 1103, the liquid on the electrical/thermal converter is heated quickly to generate a bubble in the liquid, and the liquid is discharged from a discharge port 111 by growth and contraction of the bubble, thereby forming a liquid droplet.

(Third Embodiment)

Here, another embodiment effective as a head structure using the anti-cavitation layer of α-Ta/β-Ta. Further, the head structure described herein can appropriately be combined with the above-mentioned embodiments.

Figure 7:
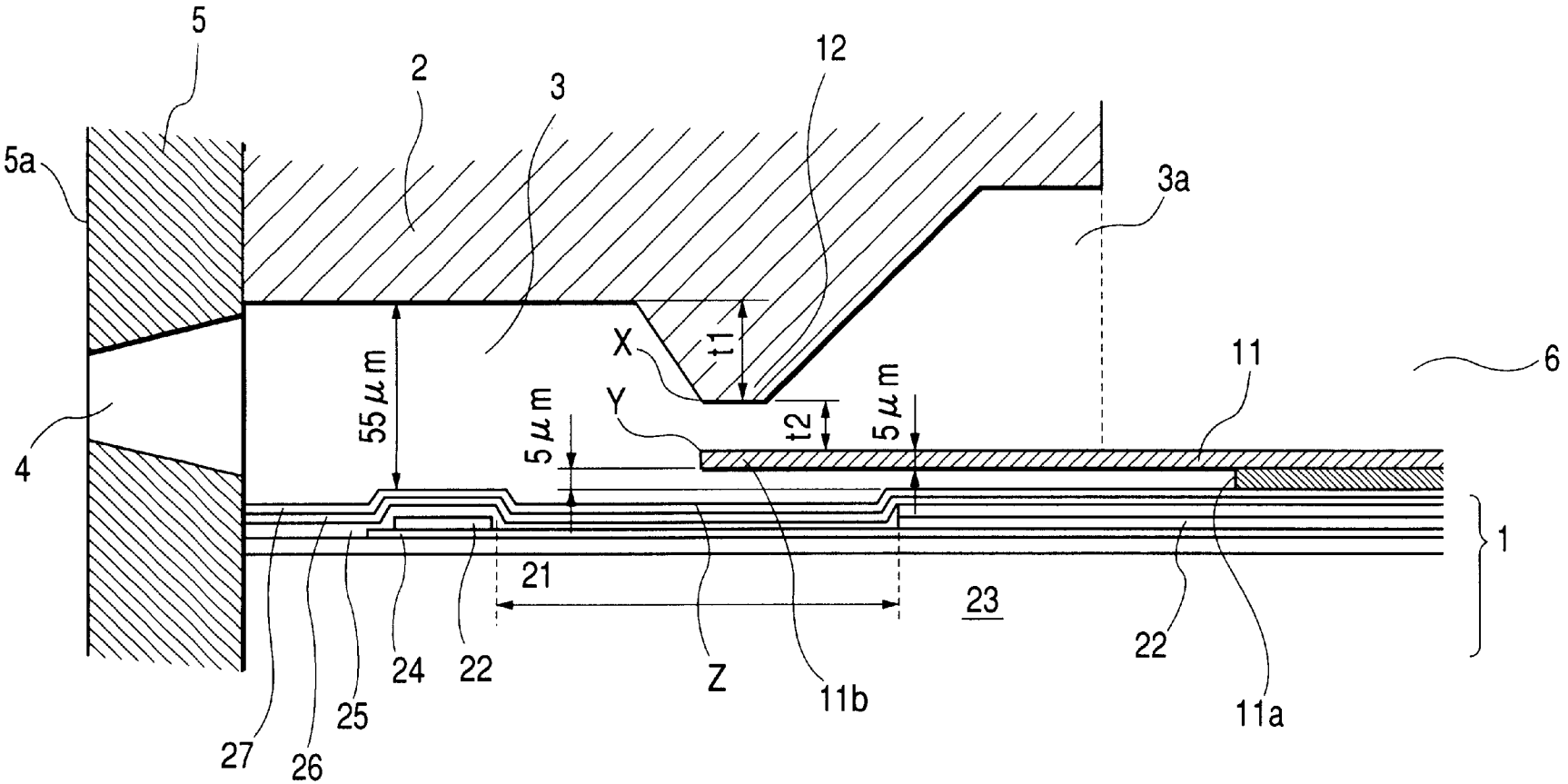
FIG. 7 is a schematic side sectional view showing an embodiment of a liquid discharge head suitable for the head substrate of the present invention.

FIG. 7 is a schematic side sectional view showing a liquid discharging portion of an embodiment of a liquid discharge head to which the head substrate of the present invention can be applied. Further, FIGS. 8A to 8E are views for explaining one-shot liquid discharging steps or processes from the liquid discharge head shown in FIG. 7.

First of all, a construction of the liquid discharge head will be explained with reference to FIG. 7.

The liquid discharge head comprises an element substrate 1 including heat generating portions 21 as bubble generating means and a movable member 11, a top plate 2 on which stoppers (regulating portions) 12 are formed, and an orifice plate 5 in which discharge ports 4 are formed.

Flow paths (liquid flow paths) 3 are formed by laminating the element substrate 1 and the top plate 2. Further, a plurality of flow paths 3 are formed side by side in the single liquid discharge head and are communicated with downstream side (left in FIG. 7) discharge ports 4 for discharging liquid. A bubble generating area exists in the vicinity of an area where the heat generating portion 21 contacts with the liquid. Further, a large volume common liquid chamber 6 are communicated with the flow paths 3 simultaneously at an upstream side thereof (right in FIG. 7). Namely, the flow paths 3 are branched from the single common liquid chamber 6. A height of the common liquid chamber 6 is higher than a height of each flow path 3.

The movable member 11 is supported at its one end in a cantilever fashion and is secured to the element substrate 1 at an upstream side of the ink flowing direction, and portions of the movable member at a downstream side of a fulcrum 11*a* can be displaced in an up-and-down direction with respect to the element substrate 1. In an initial condition, the movable member 11 is positioned substantially in parallel with the element substrate 1 with a gap therebetween.

The movable member 11 provided on the element substrate 1 is positioned so that free ends 11*b* thereof are located in central areas of the heat generating portions 21. Further, each stopper 12 regulates an upward movement of the free end 11*b* of the movable member 11 by abutting against the free end. During the regulation of displacement of the movable member 11 (upon contact of the movable member) by the contact between the movable member 11 and the stopper 12, due to the presence of the movable member 11 and the stopper 12, the flow path 3 is substantially blocked at the upstream side by the presence of the movable member 11 and the stopper 12 and at the downstream side by the presence of the movable member 11 and the stopper 12.

A position Y of the free end 11*b* and an end X of the stopper 12 are preferably positioned in a plane perpendicular to the element substrate 1. More preferably, these positions X, Y are positioned together with the center Z of the heat generating portion 21 on the plane perpendicular to the element substrate.

Further, a height of the flow path 3 at the downstream side of the stopper 12 is abruptly increased. With this arrangement, even when the movable member 11 is regulated by the stopper 12, since the adequate flow path height is maintained, growth of a bubble is not obstructed, with the result that the liquid can be smoothly directed toward the discharge port 4. Further, since unevenness in pressure balance between a lower end and an upper end of the discharge port 4 in a height direction is reduced, good liquid discharge can be achieved. Incidentally, in the conventional liquid discharge head having no movable member 11, if such a flow path structure is used, stagnation is generated at a zone where the flow path height is increased at the downstream side of the stopper 12, and bubbles are trapped in the stagnation zone, which is nor preferable. However, in the illustrated embodiment, as mentioned above, since the flow of liquid reaches the stagnation zone, bubbles are almost not trapped.

Further, the ceiling configuration at the upstream side of the stopper 12 toward the common liquid chamber 6 is abruptly risen.

With this arrangement, if there is no movable member 11, since liquid resistance at the downstream side of the bubble generating area is smaller than that at the upstream side, the pressure used for the discharging is hard to be directed toward the discharge port 4. However, in the illustrated embodiment, during the formation of the bubble, since the shifting of the bubble to the upstream side of the bubble generation area is substantially blocked by the movable member 11, the pressure used for the discharging is positively directed toward the discharge port 4, and, during the supplying of ink, since the liquid resistance at the upstream side of the bubble generating area is small, the ink can immediately be supplied to the bubble generating area.

According to the above-mentioned arrangement, a growing component of the bubble directing toward the downstream side is not even with respect to a growing component of the bubble directing toward the upstream side, and the growing component toward the upstream side becomes small and the shifting of the liquid toward the upstream side is suppressed. Since the flow of the liquid toward the upstream side is suppressed, a retard amount of meniscus after discharging is decreased, and an amount of meniscus protruding from the orifice surface (liquid discharge surface) 5*a* in the re-fill is also decreased accordingly. Therefore, since vibration of meniscus is suppressed, stable discharging can be realized in all driving frequencies from low frequency to high frequency.

Incidentally, in the illustrated embodiment, a path structure between the downstream side portion of the bubble and the discharge port 4 is maintained to "straight communication condition" with respect to the liquid flow. Regarding this, more preferably, it is desirable to create an ideal condition that discharging conditions such as discharging direction and discharging speed of a discharge droplet 66 (described later) are stabilized with very high level by linearly aligning a propagating direction of the pressure wave generated during the generation of the bubble, a flowing direction of the liquid caused thereby and a discharging direction with each other. In the illustrated embodiment, as one definition for achieving or approximating such an ideal condition, it may be designed so that the discharge port 4 is directly connected to the heat generating portion 21, particularly to the discharge port 4 side (downstream side) portion of the heat generating portion 2 affecting an influence upon the discharge port 4 side portion of the bubble. In this arrangement, if there is no liquid in the flow path 3, the heat generating portion 21, particularly, the downstream side portion of the heat generating portion 21 can be observed from the outside of the discharge port 4.

Next, dimensions of various constructural elements will be explained.

In the illustrated embodiment, by checking or examining the going-around of the bubble onto the upper surface of the movable member 11 (going-around the bubble to the upstream side of the bubble generating area), it was found that, in dependence upon a relationship between the shifting speed of the movable member and the bubble growing speed (in other words, shifting speed of liquid), the going-around of the bubble onto the upper surface of the movable member can be prevented, thereby obtaining a good discharging property.

That is to say, in the illustrated embodiment, by regulating the displacement of the movable member by means of the regulating portions at a time when a volume changing ratio of the bubble and a displacement volume changing ratio of the movable member tend to be increased, the going-around of the bubble onto the upper surface of the movable member can be prevented, thereby obtaining a good discharging property.

Figure 10:
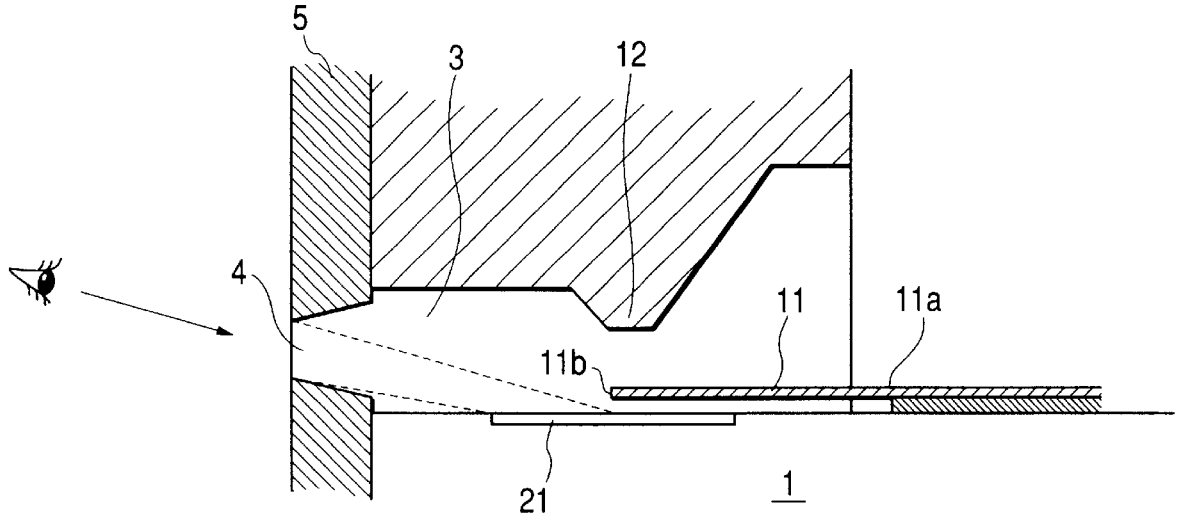
FIG. 10 is a sectional view of a flow path for explaining "straight communicating condition"

This will be fully explained with reference to FIGS. 8A to 8E. However, although the construction of the element substrate 1 in FIGS. 8A to 8E is as shown in FIG. 7, for convenience, it is schematically shown in FIGS. 8A to 8E (similar in FIGS. 10 and 11).

Figure 8A:
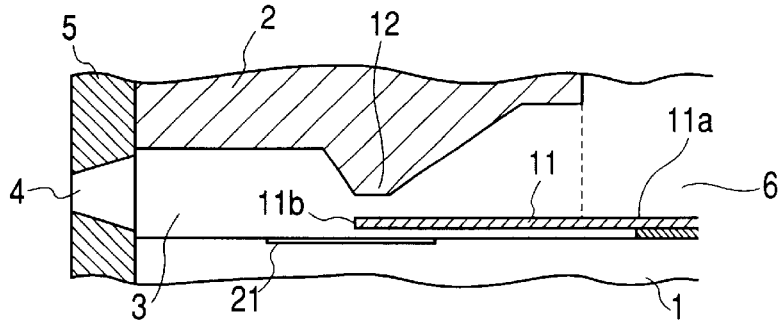
FIGS. 8A, 8B, 8C, 8D and 8E are views for explaining discharging steps of liquid from the liquid discharge head shown in FIG. 7.
Figure 8B:
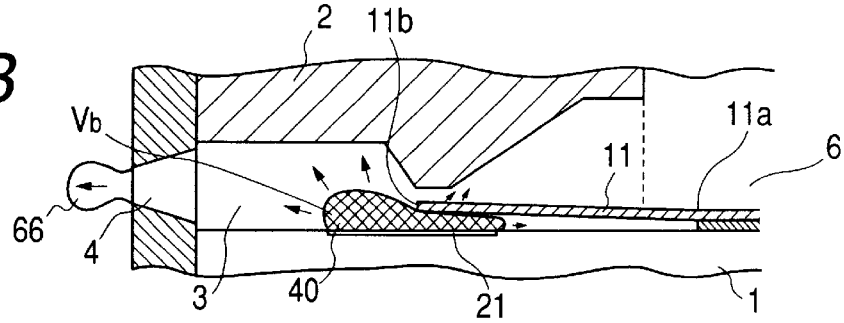

First of all, from a condition shown in FIG. 8A, a when a bubble is generated on the heat generating portion 21, a pressure wave is generated instantaneously. When liquid around the heat generating portion 21 is shifted by the pressure wave, the bubble 40 is being grown. Initially, the movable member 11 is displaced upwardly to substantially follow the shifting of the liquid (FIG. 8B). As time goes on, since an inertia force of the liquid becomes small, by an elastic force of the movable member 11, the displacing speed of the movable member 11 is abruptly reduced. In this case, since the shifting speed of the liquid is not so reduced, a difference between the shifting speed of the liquid and the shifting speed of the movable member 11 becomes great. At this point, if a gap between the movable member 11 (free end 11*b*) and the stopper 12 is still remained, the liquid flows into an upstream side of the bubble generating area, with the result that the movable member 11 is hard to be contacted with the stopper 12 and a discharging force is partially lost. Accordingly, in such a case, adequate regulating (blocking) effect of the movable member 11 by means of the regulating portion (stopper 12) cannot be achieved.

To the contrary, in the illustrated embodiment, the regulation of the movable member by means of the regulating portion is performed at a stage that the displacement of the movable member substantially follows the shifting of the liquid. Here, for convenience, the displacement speed of the movable member and the growing speed of the bubble (shifting speed of the liquid) are represented by "movable member displacement volume changing ratio" and "bubble volume changing ratio", respectively.

Incidentally, "movable member displacement volume changing ratio" and "bubble volume changing ratio" are obtained by differentiating the movable member displacement volume and the bubble volume.

With the arrangement as mentioned above, since the flow of the liquid causing the going-around of the bubble onto the upper surface of the movable member 11 is generally eliminated and a sealed condition of the bubble generating area can be attained more positively, the good discharging property can be obtained.

According to the illustrated arrangement, even after the movable member 11 is regulated by the stopper 12, the bubble 40 continues to be grown. In this case, it is desirable that an adequate distance (protruded height of the stopper 12) between the stopper 12 portion and a surface (upper wall surface) of the flow path 3 opposed to the substrate 1 is maintained to promote free growth of the downstream component of the bubble 40.

Incidentally, in a new liquid discharge head proposed by the Inventors, regulation of displacement of the movable member by means of the regulating portion represents a condition that the displacement volume changing ratio of the movable member becomes zero or minus (negative).

The height of the flow path 3 is 55 ($\mu$m), and a thickness of the movable member 11 is 5 ($\mu$m). In a condition that the bubble is not generated (in a condition that the movable member 11 is not displaced), a clearance between the lower surface of the movable member 11 and the upper surface of the element substrate 1 is 5 ($\mu$m).

Further, in a case where it is assumed that a height from the flow path wall surface of the top plate 2 to the distal end of the stopper 12 is $t_1$ and a clearance between the upper surface of the movable member 11 and the distal end of the stopper 12 is $t_2$, when $t_1$ is greater than 30 ($\mu$m), the stable liquid discharging property can be obtained, by selecting $t_2$ to 15 ($\mu$m) or less. Further, when $t_1$ is greater than 20 ($\mu$m), $t_2$ is preferably smaller than 25 ($\mu$m).

Next, a one-shot discharging operation of the liquid discharge head according to the illustrated embodiment will be fully explained with reference to FIGS. 8A to 8E and FIG. 9 showing time-lapse change in displacement speed and volume of the bubble and time-lapse change in displacement speed and displacement volume of the movable member.

Figure 9:
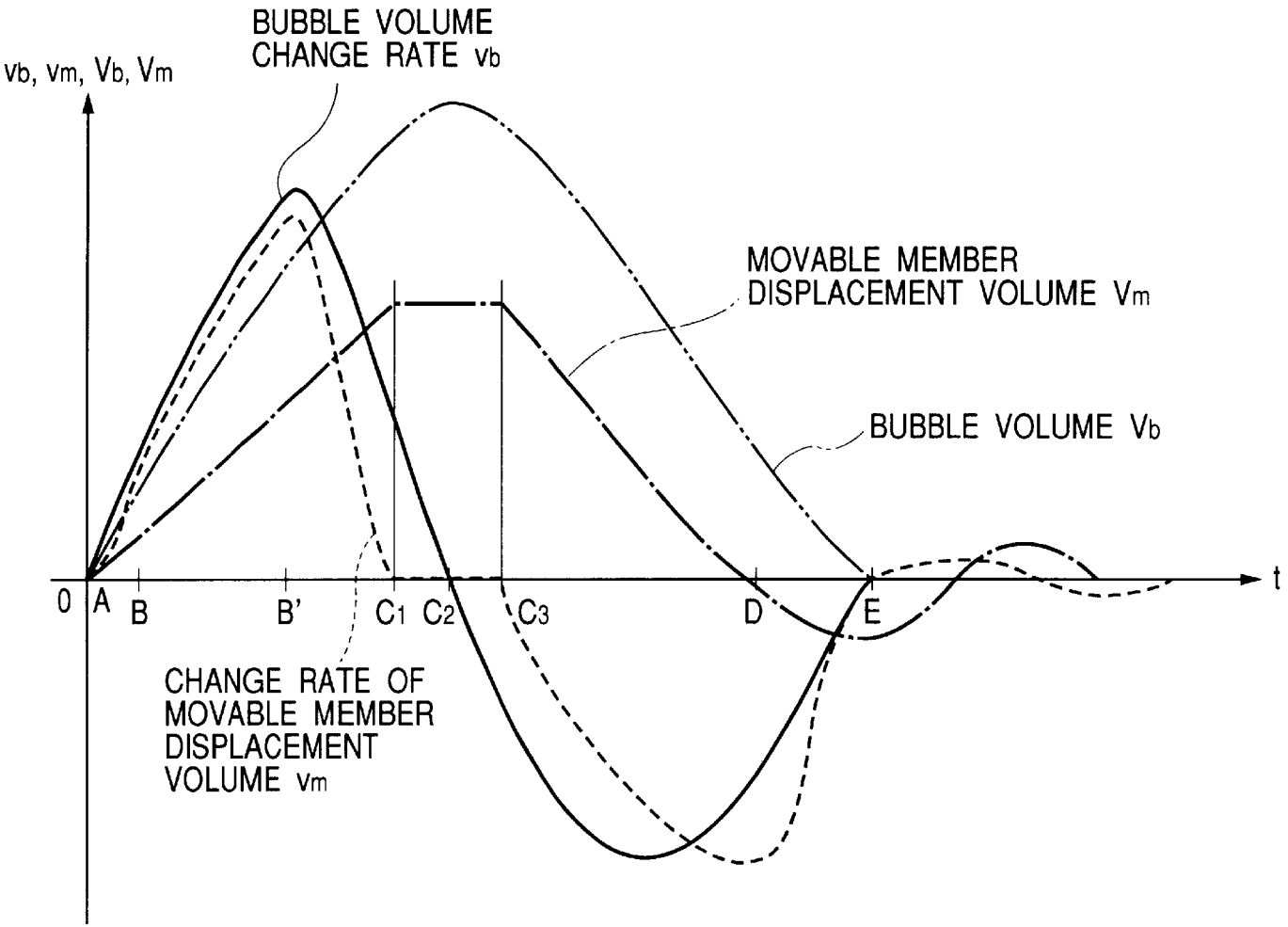
FIG. 9 is a graph time-lapse change in displacing speed and volume of a bubble and time-lapse change in displacing speed and displacement volume of a movable member.

In FIG. 9, the bubble volume changing ratio $V_b$ is shown by the solid line, bubble volume $V_b$ is shown by the two dot and chain line, movable member displacement volume changing ratio $V_m$ is shown by the broken line, and movable member displacement volume $V_m$ is shown by the dot and chain line. Further, the bubble volume changing ratio $V_b$ is positive when the bubble volume $V_b$ is increased, the bubble volume $V_b$ is positive when the volume is increased, the movable member displacement volume changing ratio $V_m$ is positive when the movable member displacement volume $V_m$ is increased, and the movable member displacement volume $V_m$ is positive when the volume is increased. Incidentally, since the movable member displacement volume $V_m$ is positive on the basis of the volume obtained when the movable member 11 is shifted from an initial condition shown in FIG. 8A toward the top plate 2, when the movable member 11 is shifted from the initial condition toward the element substrate 1, the movable member displacement volume $V_m$ indicates a negative value.

FIG. 8A shows a condition before energy such as electrical energy is applied to the heat generating portion 21, i.e., a condition before the heat generating portion 21 generates the heat. As will be described later, the movable member 11 is positioned at an area opposed to the upstream half of the bubble generated by the heat of the heat generating portion 21.

In FIG. 9, this condition corresponds to A point where time t=0.

FIG. 8B shows a condition that a part of the liquid filling the bubble generating area is heated by the heat generating portion 21 and the bubble 40 starts to be generated by film-boiling. In FIG. 9, this condition corresponds to an area from B point to immediately before $C_1$ point, and, in this case, the bubble volume $V_b$ is increased as the time goes on. Incidentally, in this case, starting of the displacement of the movable member 11 is delayed from the volume change of the bubble 40. That is to say, the pressure wave generated by generation of the bubble 40 due to film-boiling is propagated in the flow path 3, and the liquid is shifted from the central zone of the bubble generating area toward the downstream and upstream sides accordingly, and, in the upstream side, the movable member 11 starts to be displaced by the flow of the liquid caused by the growth of the bubble 40. Further, the liquid shifting toward the upstream side passes between the side walls of the flow path 3 and the movable member 11 and is directed toward the common liquid chamber 6. At this point, the clearance between the stopper 12 and the movable member 11 is decreased as the movable member 11 is displaced. In this condition, the discharge droplet 66 starts to be discharged from the discharge port 4.

Figure 8C:
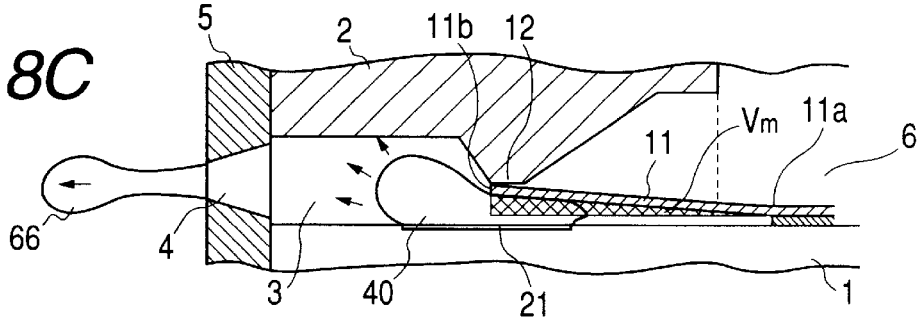

FIG. 8C shows a condition that the free end 11*b* of the movable member 11 is contacted with the stopper 12 by the further growth of the bubble 40. In FIG. 9, this condition corresponds to an area between $C_1$ point and $C_3$ point.

From the condition shown in FIG. 8B, the movable member displacement volume changing ratio $V_m$ is abruptly decreased before a condition, shown in FIG. 8C, that the movable member 11 contacts with the stopper 12, i.e., at B' point when B point is shifted to $C_1$ point in FIG. 9. The reason is that, immediately before the movable member 11 contacts with the stopper 12, flow resistance of the liquid between the movable member 11 and the stopper 12 becomes great abruptly. Further, the bubble volume changing ratio $V_b$ is also decreased abruptly.

Thereafter, the movable member 11 further approaches the stopper 12 and ultimately contacts with the latter. The contact between the movable member 11 and the stopper 12 is positively realized since the height $t_1$ of the stopper 12 and the clearance between the upper surface of the movable member 11 and the stopper 12 are dimensioned as mentioned above. When the movable member 11 contacts with the stopper 12, since the further upward displacement of the movable member is regulated ($C_1$ to $C_3$ points in FIG. 9), the shifting of the liquid toward the upstream direction is greatly regulated. In accordance with this, the growth of the bubble 40 toward the upstream direction is also limited by the movable member 11. However, since the shifting force of the liquid toward the upstream direction is great, the movable member 11 is subjected to greater stress to be pulled toward the upstream direction, with the result that the movable member is slightly deformed in a convex form upwardly. Incidentally, in this case, the bubble 40 continues to be grown. Since the upstream growth of the bubble is regulated by the stopper 12 and the movable member 11, the bubble 40 is further grown in the downstream side, with the result that the growing height of the bubble 40 at the downstream side of the heat generating portion 21 is increased in comparison with a case where the movable member 11 is not provided. That is to say, as shown in FIG. 9, although the movable member displacement volume changing ratio $V_m$ is zero between $C_1$ and $C_3$ points because the movable member 11 is contacted with the stopper 12, the bubble 40 is grown toward the downstream side and continues to be grown till point $C_2$ slightly delayed timing from $C_1$ point, and the bubble volume $V_b$ becomes maximum at the $C_2$ point.

On the other hand, as mentioned above, since the displacement of the movable member 11 is regulated by the stopper 12, the upstream side portion of the bubble 40 has the small size until the movable member 11 is curved convexly toward the upstream side by the inertia force of the flow of liquid toward the upstream side and the stress is charged. The upstream side portion of the bubble 40 is regulated by the stopper 12, flow path side walls, movable member 11 and fulcrum 11*a* so that an advancing amount toward the upstream area becomes almost zero.

In this way, the flow of the liquid toward the upstream side is greatly reduced, thereby preventing cross-talk of liquid to the adjacent flow paths, back flow (obstructing high speed re-fill) of liquid in the liquid supplying system and pressure vibration.

Figure 8D:
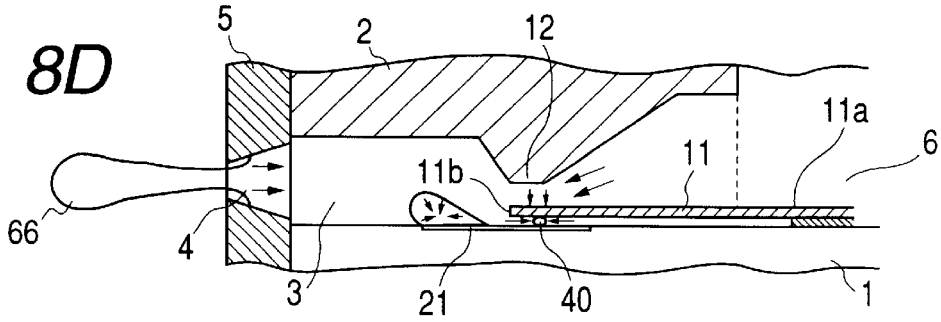

FIG. 8D shows a condition that negative pressure within the bubble 40 after the film-boiling overcomes the downstream shifting of the liquid in the flow path 3 to start contraction of the bubble 40.

As the bubble 40 is contracted ($C_2$ to E points in FIG. 9), although the movable member 11 is displaced downwardly ($C_3$ to D points in FIG. 9), since the movable member 11 itself has cantilever spring stress and stress due to upward convex deformation, a speed for downward displacement is increased. Further, since the flow path resistance is small, the downstream flow of the liquid at the upstream side area of the movable member 11 which is a low flow path resistance area formed between the common liquid chamber 6 and the flow path 3 becomes great flow quickly and flows into the flow path 3 through the stopper 12. In this operation, the liquid in the common liquid chamber 6 is directed into the flow path 3. The liquid directed into the flow path 3 passes between the stopper 12 and the downwardly displaced movable member 11 as it is, and then, flows into the downstream side of the heat generating portion 21 and acts on the bubble 40 to accelerate the disappearance of the bubble. After such flow of liquid aids the disappearance of the bubble, it creates liquid flow toward the discharge port 4 to aid restoring of the meniscus and to enhance the re-fill speed.

At this stage, liquid pole comprised of the discharge droplet 66 discharged from the discharge port 4 is changed to a liquid droplet which is in turn flying outwardly.

FIG. 8D shows a condition that the meniscus is pulled into the discharge port 4 by disappearance of the bubble and the liquid pole of the discharge droplet 66 starts to be separated.

Further, since the flowing of liquid into the flow path 3 through the area between the movable member 11 and the stopper 12 increases a flow speed at the top plate 2 side, accumulation of minute bubbles at that portion is substantially prevented, thereby contributing the stable discharging.

Further, since the generating point of cavitation due to disappearance of the bubble is shifted to the downstream side of the bubble generating area, the damage to the heat generating portion 21 is reduced. At the same time, since adhesion of kogation to the heat generating portion 21 due to the developing is reduced, the discharging stability is enhanced.

Figure 8E:
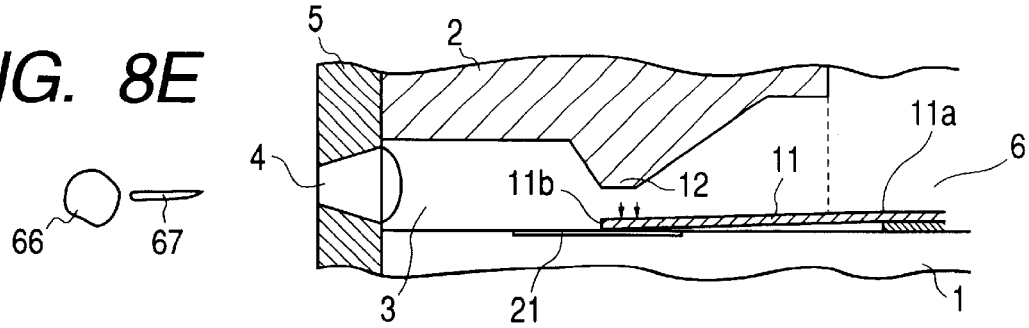

FIG. 8E shows a condition that, after the bubble 40 is completely disappeared, the movable member 11 is overshot from the initial condition (E point and so on in FIG. 9).

Although depending upon the rigidity of the movable member 11 and viscosity of the liquid used, the overshoot of the movable member 11 is attenuated for a short time and the initial condition is restored.

Although FIG. 8C shows a condition that the meniscus is pulled up to substantial upstream side by the disappearance of the bubble, similar to the attenuation of the displacement of the movable member 11, the original position is restored for a relatively short term and is stabilized. Further, as shown in FIG. 8E, rearwardly of the discharge droplet 66, the tail portion is separated by the surface tension force, with the result that a satellite 67 may be formed.

Figure 11:
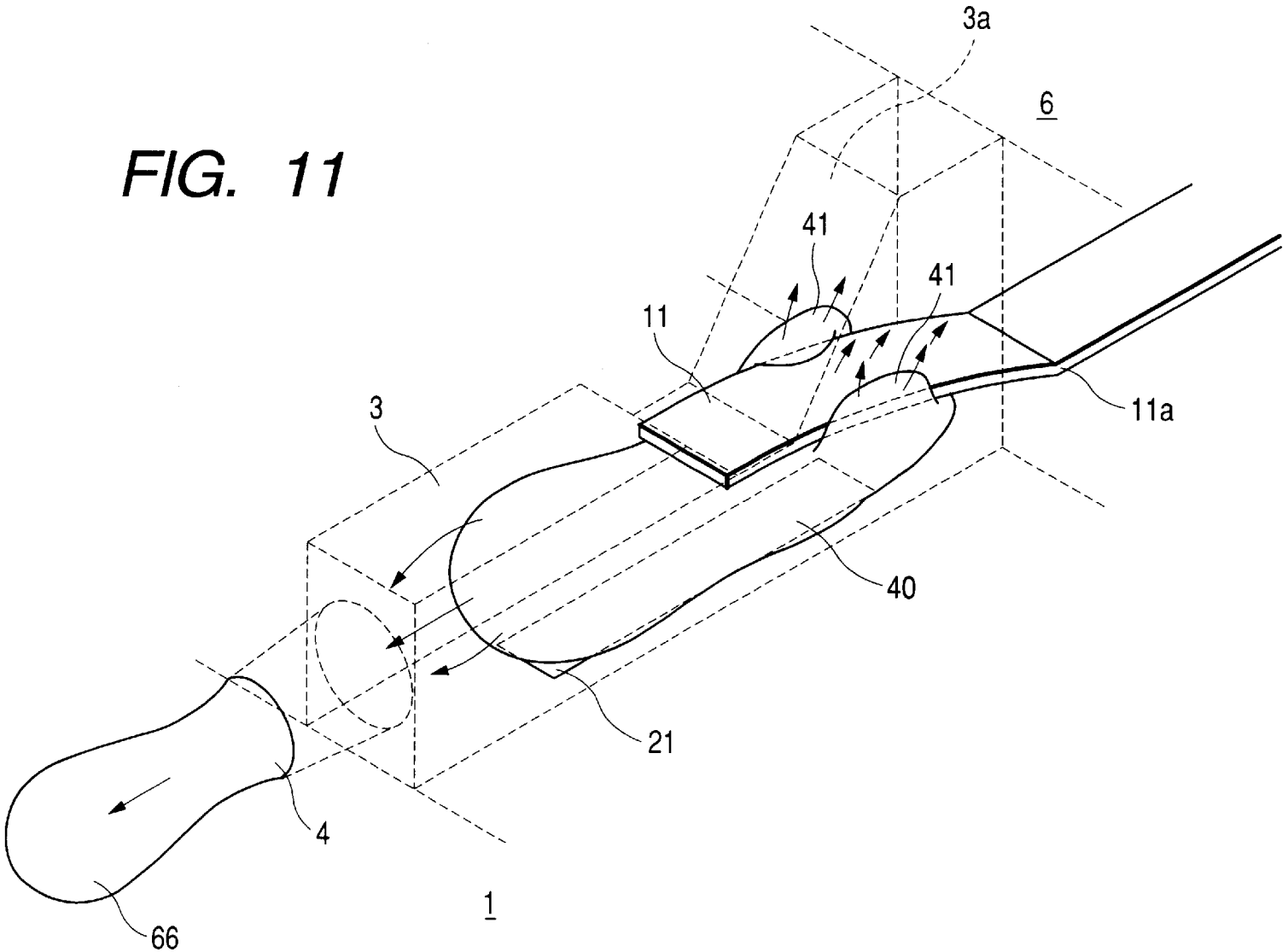
FIG. 11 is a perspective view of a part of the head shown in FIG. 7.

Next, particularly, rising bubbles 41 rising from both sides of the movable member 11 and the liquid meniscus at the discharge port 4 will be fully explained with reference to FIG. 11 which is a perspective view of a part of the liquid discharge head of FIG. 7.

In the illustrated embodiment, small clearances exist between the wall surfaces of the side walls constituting the flow path 3 and both lateral edges of the movable member 11, so that the movable member 11 can be displaced smoothly. Further, in the growing process of the bubble by means of the heat generating portion 21, the bubble 40 displaces the movable member 11 and is risen toward the upper surface of the movable member 11 through the clearances to slightly penetrate into the low flow path resistance area 3*a*. The penetrated rising bubbles 41 go around the back surface (opposed to the bubble generating area), thereby suppressing the vibration of the movable member 11 and stabilizing the discharging property.

Further, in the disappearing step of the bubble 40, the rising bubbles 41 promote the liquid flow from the low flow path resistance area 3*a* to the bubble generating area, with the result that, in combination with the above-mentioned high speed retard of the meniscus from the discharge port 4, the disappearance of the bubble is completed quickly. Particularly, due to the liquid flow created by the rising bubbles 41, bubbles are not almost trapped at corners of the movable member 11 and the flow path 3.

In the liquid discharge head having the above-mentioned arrangement, at the time when the liquid is discharged from the discharge port 4 by the generation of the bubble 40, the discharge droplet 66 is discharged substantially in a condition of a liquid pole having a sphere at its leading end. Although this is also true in the conventional head structures, in the illustrated embodiment, when the movable member 11 is displaced by the growth of the bubble and the displaced movable member 11 is contacted with the stopper 12, a substantially closed space (except for the discharge port) is created in the flow path 3 including the bubble generating area. Accordingly, when the bubble is disappeared in this condition, since the closed space is maintained until the movable member 11 is separated from the stopper 12 due to the disappearance of the bubble, almost disappearing energy of the bubble 40 acts as a force for shifting the liquid in the vicinity of the discharge port 4 toward the upstream direction. As a result, immediately after the disappearance of the bubble 40 starts, the meniscus is quickly sucked from the discharge port 4 into the flow path 3, with the result that a tail portion constituting the liquid pole connected to the discharge droplet 66 outside of the discharge port 4 is quickly separated by a strong force of the meniscus. Thus, satellites formed from the tail portion is reduced, thereby enhancing the print quality.

Further, since the tail portion is not pulled by the meniscus for a long term, the discharging speed is not decreased, and, since a distance between the discharge droplet 66 and the satellite becomes shorter, the satellite dots are pulled by a so-called slipstream phenomenon rearwardly of the discharge droplet 66. As a result, the satellite dots may be combined with the discharge droplet 66, and, thus, a liquid discharge head in which satellite dots are almost not created can be provided.

Further, in the illustrated embodiment, in the above-mentioned liquid discharge head, the movable member 11 is provided to suppress only the bubble 40 growing toward the upstream direction with respect to the flow of liquid directing toward the discharge port 4. More preferably, the free end 11*b* of the movable member 11 is positioned substantially at a central portion of the bubble generating area. With this arrangement, the back wave to the upstream side due to the growth of the bubble and the inertia force of the liquid which do not directly relate to the liquid discharging can be suppressed, and the downward growing component of the bubble 40 can be directed toward the discharge port 4.

Further, since the flow path resistance of the low flow path resistance area 3*b* opposite to the discharge port 4 with respect to the stopper 12 is low, the shifting of the liquid toward the upstream direction due to the growth of the bubble creates great flow in the low flow path resistance area 3*b*, with the result that, when the displaced movable member 11 contacts with the stopper 12, the movable member 11 is subjected to stress to be pulled toward the upstream direction. As a result, even when the disappearance of the bubble is started in this condition, since the liquid shifting force toward the upstream direction due to the growth of the bubble 40 remains greatly, the above-mentioned closed space can be maintained for a predetermined time period until the repelling force of the movable member 11 overcomes the liquid shifting force. That is to say, with this arrangement, high speed retarding of the meniscus can be achieved more positively.

Further, when the disappearance of the bubble advances and the repelling force of the movable member 11 overcomes the liquid shifting force toward the upstream direction due to the growth of the bubble, the movable member 11 is displaced downwardly to tray to be returned to the initial condition, with the result that the flow toward the downstream direction is created in the low flow path resistance area 3*a*. Since the flow path resistance is small, the flow toward the downstream direction in the low flow path resistance area 3*a* abruptly becomes great flow which in turn flows into the flow path 3 through the stopper 12. As a result, by the liquid shifting toward the downstream direction directing toward the discharge port 4, the retarding of the meniscus is braked quickly, thereby attenuating vibration of meniscus at a high speed.

In the liquid discharge head having the above-mentioned construction and including the movable member, since the ink re-fill property is enhanced, high frequency driving area can be set to 10 kHz lever, and the driving can be effected in a level from about 20 kHz to 30 kHz.

In this case, although the disappearance of the bubble is repeated at the above-mentioned high frequency period and many accumulative stresses are given to the anti-cavitation layer within a unit time, the anti-cavitation layer of α-Ta/β-Ta according to the present invention stabilizes the discharging speed and the discharge amount.

Next, an ink jet recording apparatus in which the above-mentioned liquid discharge head is used as an ink jet recording head will be explained.

Figure 12:
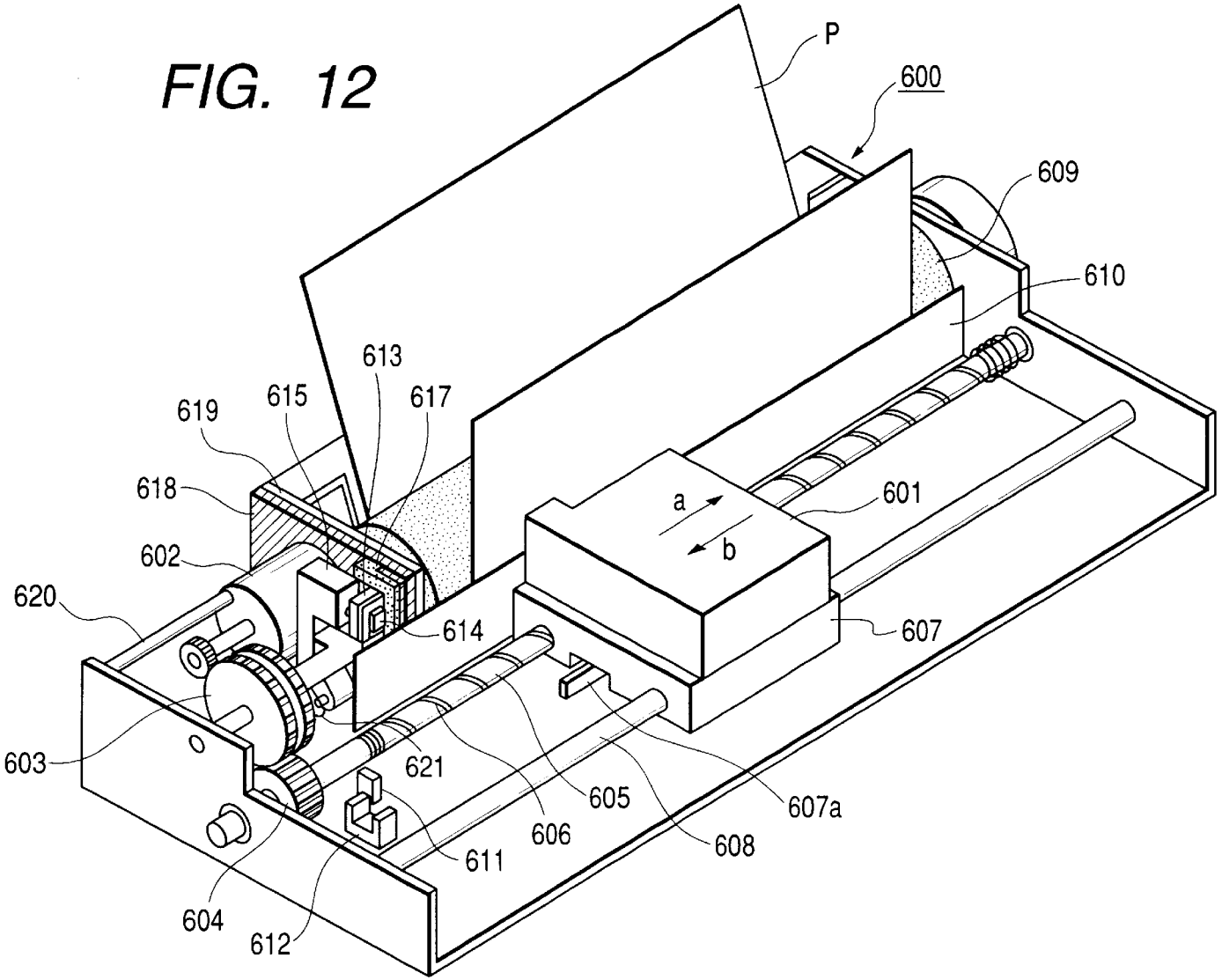
FIG. 12 is a schematic perspective view showing main parts of an ink jet recording apparatus to which the present invention is applied.

FIG. 12 is a schematic perspective view showing main parts of an ink jet recording apparatus to which the present invention is applied.

A head cartridge 601 mounted on an ink jet apparatus 600 shown in FIG. 12 comprises a liquid discharge head for discharging ink to effect recording, and plural color ink tanks for storing liquids to be supplied to the liquid discharge head.

As shown in FIG. 12, the head cartridge 601 is mounted on a carriage 607 engaged by a helical groove 606 of a lead screw 605 rotated via a driving force transmitting gears 603, 604 in synchronous with normal and reverse rotations of a driving motor 602. By a power of the driving motor 602, the head cartridge 601 is reciprocally shifted together with the carriage 607 in directions shown by the arrows a and b along a guide 608. The ink jet recording apparatus 600 includes recording medium conveying means (not shown) for conveying a print paper P as a recording medium for receiving liquid such as ink discharged from the head cartridge 601. A paper pressing plate 610 for the print paper P conveyed on a platen 609 by means of the recording medium conveying means serves to urge the print paper P against the platen 609 through a shifting direction of the carriage 607. The head cartridge 601 is electrically connected to a main body of the ink jet recording apparatus via a flexible cable (not shown).

Photo-couplers 611, 612 are disposed in the vicinity of one end of the lead screw 605. The photo-couplers 611, 612 are home position detecting means for switching a rotational direction of the driving motor 602 by ascertaining the presence of a lever 607*a* of the carriage 607 in an area of the photo-couplers 611, 612. In the vicinity of one end of the platen 609, there is provided a support member 613 for supporting a cap member 614 for covering a front surface (including discharge ports) of the head cartridge 601. Further, there is provided ink sucking means 615 for sucking ink stored in the cap member 614 by idle discharge of the head cartridge 601. Suction recovery of the head cartridge 601 is effected by means of the ink sucking means 615 through an opening of the cap member 614.

The ink jet recording apparatus 600 has a body support 619. The body support 619 supports a shifting member 618 for shifting movement in a front-and-rear direction, i.e., direction perpendicular to a shifting direction of the carriage 607. A cleaning blade 617 is attached to the shifting member 618. The cleaning blade 617 is not limited to a blade, but, other known type of cleaning blade may be used. Further, there is provided a lever 620 for starting the suction recovery operation of the ink sucking means 615. The lever 620 is shifted as a cam engaging by the carriage 607 is shifted, and a driving force from the driving motor 602 is controlled by known transmitting means such as clutch switching. An ink jet recording control portion (not shown in FIG. 12) for supplying a signal to the heat generating portions and for controlling the driving of various elements is provided in the main body of the recording apparatus.

What is claimed is:

1. An ink jet head substrate comprising:

a heat generating resistance member forming a heat generating portion;

an electrode wiring electrically connected to said heat generating resistance member; and an insulation protection layer provided over said heat generating resistance member and said electrode wiring and an anti-cavitation film provided over said insulation protection layer, wherein said anti-cavitation film is formed from at least two layers of film, a first layer comprising a metal film, having a crystal structure, in contact with an ink, and a second layer comprising an amorphous alloy film in contact with the first layer.

2. An ink jet head substrate comprising:

a heat generating resistance member forming a heat generating portion;

an electrode wiring electrically connected to said heat generating resistance member; and an insulation protection layer provided over said heat generating resistance member and said electrode wiring and an anti-cavitation film provided over said insulation protection layer, wherein said anti-cavitation film is formed from at least two layers of film, an upper layer film contacted with ink is a Ta film or a TaAl film, and the lower layer film is an amorphous alloy film including Ta.

3. An ink jet head substrate comprising:

a heat generating resistance member forming a heat generating portion;

an electrode wiring electrically connected to said heat generating resistance member; and an insulation protection layer provided over said heat generating resistance member and said electrode wiring and an anti-cavitation film provided over said insulation protection layer, wherein said anti-cavitation film is formed from at least two layers of film, an upper layer film contacted with ink is a Ta film or a TaAl film, and the lower layer film is an amorphous alloy film including Ta, and said amorphous alloy film has a composition comprised of Ta, Fe, Ni, and Cr.

4. An ink jet head substrate according to claim 3, wherein said amorphous alloy film is represented by the following composition (I):

$$Ta_{\alpha}Fe_{\beta}Ni_{\gamma}Cr_{\delta} \quad (I)$$

wherein 10 atom %≦α≦30 atom % and α+β<80 atom % and α<β and δ>γ and α+β+γ+δ=100 atom %.

5. An ink jet head substrate comprising:

a heat generating resistance member forming a heat generating portion;

an electrode wiring electrically connected to said heat generating resistance member; and an insulation protection layer provided over said heat generating resistance member and said electrode wiring and an anti-cavitation film provided over said insulation protection layer, wherein said anti-cavitation film is formed from at least two layers of film, a first layer comprising a metal film, having a crystal structure, in contact with an ink, and a second layer comprising an amorphous alloy film in contact with the first layer, said amorphous alloy film having a composition comprised of Ta, Fe, Ni, and Cr.

6. An ink jet head substrate according to claim 5, wherein said amorphous alloy film is represented by the following composition (I):

$$Ta_{\alpha}Fe_{\beta}Ni_{\gamma}Cr_{\delta} \quad (I)$$

wherein 10 atom %≦α≦30 atom % and α+β<80 atom % and α<β and δ>γ and α+β+γ+δ=100 atom %.

7. An ink jet head, wherein a plurality of heat generating portions are provided on an ink jet head substrate according to any one of claims 1 to 6, and liquid paths communicated with discharge ports for discharging an ink droplet are provided in correspondence with said heat generating portions.

8. An ink jet head according to claim 7, wherein a movable member having a free end displaced by growth of a bubble generated in the liquid by thermal energy of said heat generating portion is provided in each said liquid path.

9. An ink jet head according to claim 7, wherein only one kind of ink is supplied to each said liquid path.

10. An ink jet head according to claim 9, wherein the ink is resistant to kogation and erosion.

11. A method for manufacturing an ink jet head substrate having a heat generating resistance member forming a heat generating portion, an electrode wiring electrically connected to the heat generating resistance member, and an insulation protection layer provided over the heat generating resistance member and the electrode wiring and an anti-cavitation film provided over the insulation protection layer, wherein the anti-cavitation film is formed from at least two layers of film, a first layer comprising a metal film, having a crystal structure, in contact with an ink, and a second layer comprising an amorphous alloy film in contact with the first layer, the amorphous alloy film having a composition comprised of Ta, Fe, Ni, and Cr, wherein, the first layer is formed by sputtering using a metal Ta target having a purity of 99% or more.

12. A method according to claim 11, wherein the layer having a composition comprised of Ta, Fe, Ni, and Cr is represented by the following composition relationship (I):

$$Ta_{\alpha}Fe_{\beta}Ni_{\gamma}Cr_{\delta} \quad (I)$$

wherein 10 atom %≦α≦30 atom % and α+β<80 atom % and α<β and δ>γ and α+β+γ+δ=100 atom %.

13. An ink jet head made by a method according to claim 11, wherein a plurality of heat generating portions are provided on an ink jet head substrate and liquid paths communicated with discharge ports for discharging an ink droplet are provided in correspondence with the heat generating portions.

14. An ink jet head according to claim 13, wherein a movable member having a free end displaced by growth of a bubble generated in the liquid by thermal energy of said heat generating portion is provided in each said liquid path.

15. An ink jet head made by a method according to claim 11, wherein the discharge of the ink from said ink jet head is effected when partially removing Ta of an upper layer and when removing Ta in an effective bubbling area of said ink jet head.

16. A method for manufacturing an ink jet head obtained by forming a plurality of liquid paths communicated with discharge ports for discharging an ink droplet in correspondence to heat generating portions on an ink jet head substrate comprising heat generating resistance members forming heat generating portions, electrode wirings electrically connected to the heat generating resistance members, and an insulation protection layer provided over the heat generating resistance member and the electrode wiring and an anti-cavitation film provided over the insulation protection layer, wherein the anti-cavitation film is formed from at least two layers of film, a first layer comprising a metal film, having a crystal structure, in contact with an ink, and a second layer comprising an amorphous alloy film in contact with the first layer, the amorphous alloy film having a composition comprised of Ta, Fe, Ni, and Cr, wherein, the first layer is formed by sputtering using a metal Ta target having a purity of 99% or more.

17. A method according to claim 16, wherein the layer having a composition comprised of Ta, Fe, Ni, and Cr is represented by the following composition relationship (I):

$$Ta_{\alpha}Fe_{\beta}Ni_{\gamma}Cr_{\delta} \quad (I)$$

wherein 10 atom %≦α≦30 atom % and α+β<80 atom % and α<β and δ>γ and α+β+γ+δ=100 atom %.

18. A method according to claim 17, wherein, after the liquid paths are formed, by effecting an auxiliary ink discharging operation, Ta is substantially doped to an amorphous immobile layer including at least Ta and Cr of the $Ta_{\alpha}Fe_{\beta}Ni_{\gamma}Cr_{\delta}$.

19. A method for using an ink jet head manufactured by a method according to claim 17, wherein a layer obtained by substantially doping Ta to an amorphous immobile layer including at least Ta and Cr of the $Ta_{\alpha}Fe_{\beta}Ni_{\gamma}Cr_{\delta}$ is used as a lower layer of the anti-cavitation film provided over the insulation protection layer.

20. A method for using an ink jet head manufactured by a method according to claim 17, wherein a layer obtained by adding Ta to an amorphous surface layer including at least Ta and Cr of the $Ta_{\alpha}Fe_{\beta}Ni_{\gamma}Cr_{\delta}$ is used as a lower layer of the anti-cavitation film provided over the insulation protection layer.

21. An ink jet recording apparatus comprising:

a carriage to which an ink jet head according to claim 7 is mounted, wherein recording is effected on a recording medium by discharging the ink droplet from said ink jet head while shifting said carriage in response to recording information.

* * * * *

UNITED STATES PATENT AND TRADEMARK OFFICE

CERTIFICATE OF CORRECTION

PATENT NO. : 6,530,650 B2
DATED : March 11, 2003
INVENTOR(S) : Teruo Ozaki et al.

It is certified that error appears in the above-identified patent and that said Letters Patent is hereby corrected as shown below:

Column 1,
Line 51, “actual,” should read -- actuality, --.

Column 2,
Line 1, “to” should be deleted;
Line 11, “as” should be deleted;
Line 16, “does” should be deleted;
Lines 22 and 43, “in correspondence” should read -- corresponding --; and
Line 66, “occurs” should read -- occur --.

Column 3,
Line 8, “well” should read -- very --; and
Line 35, “that high level is” should read -- for high level to be --.

Column 4,
Line 8, “Cr” should read -- Cr, and --;
Line 15, “has” should read -- have --;
Line 29, “are” (both occurrences) should read -- be --; and
Line 57, “has” should read -- have --.

Column 5,
Line 16, “is” (second occurrence) should read -- be --;
Line 44, “invention.” should read -- invention; --;
Line 49, “to” should be deleted; and
Line 60, “constituted” should read -- constituted by --.

Column 6,
Line 56, “is” should read -- are --; and
Line 63, “upon” should be deleted.

Column 7,
Line 24, “a” (second occurrence) should read -- an --;
Line 25, “layer” (first occurrence) should be deleted;
Line 26, “to” should read -- into --;
Line 32, “remained” should read -- maintained --;
Line 36, “cases,” should read -- case, --;
Line 45, “as” should be deleted; and
Line 57, “with” should be deleted.

UNITED STATES PATENT AND TRADEMARK OFFICE

CERTIFICATE OF CORRECTION

PATENT NO. : 6,530,650 B2
DATED : March 11, 2003
INVENTOR(S) : Teruo Ozaki et al.

It is certified that error appears in the above-identified patent and that said Letters Patent is hereby corrected as shown below:

Column 9,
Line 58, “Ta rich” should read -- a great deal of Ta --.

Column 10,
Line 11, “is” should read -- be --;
Line 22, “does almost” should read -- almost did --;
Line 23, “is” should read -- was --;
Line 25, “can” should read -- could --;
Line 39, “does almost” should read -- almost does --;
Line 53, “acts” should read -- causes --;
Line 54, “for bubbling” should read -- bubbling of --; and
Line 67, “as” should be deleted.

Column 11,
Line 13, “s” should read -- as --.

Column 12,
Line 16, “with” should be deleted;
Line 17, “are” should read -- is --;
Line 29, “in” should be deleted; and
Line 64, “nor” should read -- not --.

Column 13,
Line 3, “risen.” should read -- raised. --;
Line 24, “retard” should read -- delayed --;
Line 36, “that” should read -- in which --;
Line 53, “constructural” should read -- structural --; and
Line 59, “in dependence” should read -- depending --.

Column 14,
Line 11, “a” (second occurrence) should be deleted;
Line 25, “is still remained,” should read -- still remains, --;
Line 27, “be contacted” should read -- make contact --;
Line 56, “is” should read -- be --; and
Line 65, “that” should read -- where --.

Column 15,
Line 66, “that” should read -- where --.

UNITED STATES PATENT AND TRADEMARK OFFICE

CERTIFICATE OF CORRECTION

PATENT NO. : 6,530,650 B2
DATED : March 11, 2003
INVENTOR(S) : Teruo Ozaki et al.

It is certified that error appears in the above-identified patent and that said Letters Patent is hereby corrected as shown below:

Column 16,
Lines 9 and 14, “with” should be deleted.

Column 17,
Line 35, “that,” should read -- where, -- and “is” should read -- has --; and
Line 61, “risen” should read -- raised --.

Column 18,
Line 5, “retard” should read -- delay --;
Line 21, “is” should read -- has --; and
Line 62, “with” should be deleted.

Column 19,
Line 15, “flow” should be deleted.

Signed and Sealed this

Twenty-third Day of September, 2003

JAMES E. ROGAN
*Director of the United States Patent and Trademark Office*